US009704697B2

(12) United States Patent
Barofsky et al.

(10) Patent No.: US 9,704,697 B2
(45) Date of Patent: Jul. 11, 2017

(54) RADIO-FREQUENCY-FREE HYBRID ELECTROSTATIC/MAGNETOSTATIC CELL FOR TRANSPORTING, TRAPPING, AND DISSOCIATING IONS IN MASS SPECTROMETERS

(71) Applicant: Oregon State University, Corvallis, OR (US)

(72) Inventors: Douglas F. Barofsky, Corvallis, OR (US); Joseph S. Beckman, Corvallis, OR (US); Max L. Deinzer; Valery G. Voinov, Corvallis, OR (US)

(73) Assignee: Oregon State University, Corvallis, OR (US)

( * ) Notice: Subject to any disclaimer, the term of this patent is extended or adjusted under 35 U.S.C. 154(b) by 0 days.

(21) Appl. No.: 15/049,371

(22) Filed: Feb. 22, 2016

(65) Prior Publication Data

US 2016/0260595 A1 Sep. 8, 2016

Related U.S. Application Data

(63) Continuation of application No. 14/201,019, filed on Mar. 7, 2014, now Pat. No. 9,269,556, which is a continuation of application No. 12/995,400, filed as application No. PCT/US2009/045591 on May 29, 2009, now Pat. No. 8,723,113.

(Continued)

(51) Int. Cl.
*H01J 49/06* (2006.01)
*H01J 49/00* (2006.01)

(52) U.S. Cl.
CPC ..... *H01J 49/0054* (2013.01); *H01J 49/062* (2013.01)

(58) Field of Classification Search
CPC ..... H01J 49/0054; H01J 49/062
See application file for complete search history.

(56) References Cited

U.S. PATENT DOCUMENTS 2,457,530 A 12/1948 Coggeshall
3,842,269 A 10/1974 Liebl
(Continued)

FOREIGN PATENT DOCUMENTS

JP 2006185781 A 7/2006
JP 2010170754 8/2010

OTHER PUBLICATIONS

'ECD in a Linear RF-Field without Buffer Gas.' 55th ASMS Conference on Mass Spectrometry and Allied Topics, Indianapolis, Indiana: 1381 (WPE-084) poster presentation from the 55th ASMS Conference in Indianapolis, Jun. 3-7, 2007.

(Continued)

*Primary Examiner* — Wyatt Stoffa
(74) *Attorney, Agent, or Firm* — Niels Haun; Dann, Dorfman, Herrell and Skillman, P.C.

(57) ABSTRACT

Mass spectrometry cells include one or more interleaved magnetostatic and electrostatic lenses. In some examples, the electrostatic lenses are based on electrical potentials applied to magnetostatic lens pole pieces. In other alternatives, the electrostatic lenses can include conductive apertures. Applied voltages can be selected to trap or transport charged particles, and photon sources, gas sources, ion sources, and electron sources can be provided for various dissociation processes.

9 Claims, 18 Drawing Sheets

Related U.S. Application Data

(60) Provisional application No. 61/057,770, filed on May 30, 2008, provisional application No. 61/120,365, filed on Dec. 5, 2008.

(56) References Cited

U.S. PATENT DOCUMENTS 3,969,644 A 7/1976 Nowak
4,479,060 A * 10/1984 Tamura ..... H01J 37/252 250/311
4,578,663 A * 3/1986 Sanders ..... G21K 1/093 335/210
4,731,598 A * 3/1988 Clarke ..... H01F 7/0278 315/5.35
4,949,043 A * 8/1990 Hillenbrand ..... G01R 33/30 324/320
5,014,028 A * 5/1991 Leupold ..... H01F 7/0278 315/3.5
5,091,645 A 2/1992 Elliott
5,113,162 A * 5/1992 Umehara ..... H01J 29/64 250/396 ML
5,369,279 A * 11/1994 Martin ..... H01J 37/145 250/396 ML
5,563,415 A 10/1996 Crewe
6,541,781 B1 * 4/2003 Benveniste ..... H01J 37/05 250/294
6,590,206 B1 7/2003 Evrard
6,800,851 B1 * 10/2004 Zubarev ..... H01J 49/0054 250/292
6,891,157 B2 5/2005 Bateman
6,919,562 B1 7/2005 Whitehouse
6,989,533 B2 * 1/2006 Bellec ..... H01J 49/38 250/291
7,064,325 B2 * 6/2006 Buijsse ..... H01J 37/143 250/309
7,116,051 B2 * 10/2006 Vancil ..... H01J 25/14 315/5
7,148,778 B2 * 12/2006 Humphries ..... B03C 1/0332 335/306
7,164,139 B1 * 1/2007 Toth ..... H01J 37/05 250/298
7,227,133 B2 * 6/2007 Glish ..... H01J 49/0054 250/288
7,326,350 B2 * 2/2008 Mueller ..... B03C 1/035 210/222
7,381,946 B2 6/2008 Baba
7,397,025 B2 * 7/2008 Baba ..... H01J 49/0095 250/281
7,498,572 B2 * 3/2009 Fujita ..... H01J 37/1475 250/294
7,535,329 B2 * 5/2009 Gorshkov ..... G01R 33/3806 335/296
7,573,029 B2 * 8/2009 Heninger ..... H01J 49/38 250/281
7,589,321 B2 * 9/2009 Hashimoto ..... H01J 49/4225 250/281
7,612,335 B2 * 11/2009 Makarov ..... H01J 49/0054 250/281
7,635,850 B2 * 12/2009 Yamashita ..... H01J 37/05 250/281
7,655,922 B2 * 2/2010 Smatlak ..... H01J 37/026 250/396 ML
7,675,042 B2 * 3/2010 Frosien ..... H01J 9/18 250/396 ML
7,755,034 B2 * 7/2010 Ding ..... H01J 49/0054 250/281
7,807,965 B2 * 10/2010 Zach ..... H01J 37/153 250/311
7,820,961 B2 * 10/2010 Hashimoto ..... H01J 49/429 250/281
8,158,934 B2 * 4/2012 Wells ..... H01J 49/0054 250/281
8,723,113 B2 5/2014 Barofsky
9,269,556 B2 2/2016 Barofsky
9,305,760 B2 4/2016 Barofsky
2003/0183760 A1 * 10/2003 Tsybin ..... H01J 49/0054 250/292
2004/0155180 A1 * 8/2004 Zubarev ..... H01J 49/0054 250/281
2004/0245448 A1 * 12/2004 Glish ..... H01J 49/0054 250/281
2004/0245488 A1 12/2004 Isbitsky
2005/0017165 A1 1/2005 Franzen
2005/0017167 A1 1/2005 Franzen
2005/0258354 A1 * 11/2005 Baba ..... H01J 49/0095 250/281
2006/0169892 A1 * 8/2006 Baba ..... H01J 49/005 250/292
2006/0232368 A1 * 10/2006 Gorshkov ..... G01R 33/3806 335/306
2007/0023648 A1 * 2/2007 Baba ..... H01J 49/0095 250/294
2007/0069124 A1 * 3/2007 Baba ..... H01J 49/0054 250/288
2007/0138386 A1 * 6/2007 Makarov ..... H01J 49/0054 250/288
2007/0194251 A1 8/2007 Ward
2008/0073508 A1 * 3/2008 Hashimoto ..... H01J 49/0045 250/288
2008/0116372 A1 * 5/2008 Hashimoto ..... H01J 49/429 250/292
2008/0135775 A1 * 6/2008 Smatlak ..... H01J 37/026 250/396 ML
2009/0101818 A1 * 4/2009 Zach ..... H01J 37/145 250/311
2010/0237237 A1 * 9/2010 Green ..... H01J 49/004 250/283
2011/0049347 A1 * 3/2011 Wells ..... H01J 49/0054 250/282
2011/0192969 A1 * 8/2011 Verentchikov ..... H01J 49/062 250/282
2012/0193533 A1 * 8/2012 Zach ..... H01J 37/153 250/310
2014/0070087 A1 * 3/2014 Giles ..... H01J 49/062 250/282
2015/0187557 A1 * 7/2015 Barofsky ..... H01J 49/0054 250/288

OTHER PUBLICATIONS

Baba, T., et al., 'Electron Capture Dissociation in a Radio Frequency Ion Trap', Analytical Chemistry, vol. 76, No. 15, Aug. 1, 2004, pp. 4263-4266.

Baba, T., et al., "Electron Capture Dissociation in a Radio-Frequency Linear Ion Trap," Nov. 2007.

Baba, T., et al., Electron Capture Dissociation in a Tiny Penning Trap Coupled With a Linear Radio-Frequency-Quadrupole Ion Trap—Time-of-Flight—Mass Spectrometer, 2 pages, ASMS Conference, Montreal, 2003.

Baba, Takashi, et al., 'Electron-Caputre Dissociation in a Radio-Frequency Linear Ion Trap', Spectroscopy, Jul. 1, 2007.

Baba, Takeashi, et al, "High Throughout ECD in a RF Ion Trap", TP12-238, 53rd ASMS 2005, Poster.

Bushey, Jared M., et al., 'Simultaneous Collision Induced Dissociation of the Charge Reduced Parent Ion during Electron Capture Dissociation', Anal. Chem. 2009, 81, 6156-6164.

Cambpell, P., "Permanent Magnet Materials and Their Application", Cambridge University Press, Cambridge: 1994, pp. 201-202.

Cody, R.B., et al., 'Electron Impact Excitation of Ions from Organics an Alternative to Collision Induced Dissociation', Analytical Chemistry, vol. 51, No. 4, Apr. 1979, 547-551.

Dahl, P., "Introduction to Electron and Ion Optics", Academic Press: New York, 1973, pp. 42-72.

Ding, L., et al., 'Electron Capture Dissociation in a Digital Ion Trap Mass Spectrometer', Analytical Chemistry, vol. 78, No. 6, Mar. 15, 2006, pp. 1995-2000.

(56) References Cited

OTHER PUBLICATIONS

Downard, K.M., "Mass Spectrometry a Foundation Course", The Royal Society of Chemistry: Cambridge, 2004, pp. 22-83.

Extended European Search Report (EESR) dated Jul. 13, 2015 in corresponding EP Application No. 09767393.3.

Gross, J.H., "Mass Spectrometry a Textbook", Springer: New York, 2004, pp. 1-12 and 488-494.

Kjeldsen, F., et al., 'Dissociative Capture of Hot (3-13 eV) Electrons by Polypeptide Polycations: An Efficient Process Accompanied by Secondary Fragmentation', Chemical Physics Letters, vol. 356, Apr. 22, 2002, 201-206.

McCaig, M., 'Permanent Magnets in Theory and Practice', John Wiley and Sons: NY, 1977, pp. 298-303.

Moskowitz, L.R., "Permanent Magnet Design and Application Handbook", Cahners Books International: Boston, 1976, pp. 89-92.

Satake, Hiroyuki, et al., 'Fast Multiple Electron Capture Dissociation in a Linear Radio Frequency Quadrupole Ion Trap', Anal. Chem. 2007, 79, 8755-8761.

Schwartz, J., et al., 'A Two-Dimensional Quadrupole Ion Trap Mass Spectrometer', J. Am. Soc. Mass Spectrom 2002, 13, pp. 659-669.

Silivra, O., et al., 'Electron Capture Dissociation of Polypeptides in a Three-Dimensional Quadrupole Ion Trap: Implementation and First Results', J. Am. Soc. Mass Spectrom 2005, 16, pp. 22-27.

Syka, J., et al., 'Peptide and protein sequence analysis by electron transfer dissociation mass spectrometry', PNAS, Jun. 29, 2004, vol. 101, No. 26, pp. 9528-9533.

Valery G. Voinov et al.: "Radio-Frequency-Free Cell for Electron Capture Dissociation in Tandem Mass Spectrometry", Analytical Chemistry,vol. 81, No. 3, Feb. 1, 2009 (Feb. 1, 2009 ), pp. 1238-1243, XP055190702, ISSN: 0003-2700.

Voinov, V.G., et al., "Electron Capture Dissociation in a Linear Radiofrequency-Free Magnetic Cell", RCM Letter to the Editor, Rapid Communications in Mass Spectrometry, 2008; 22: 3087-3088.

Yuichiro, Hashimoto, et al., Tandem Mass Spectrometry Using an Axially Resonant Excitation Linear Ion Trap, J. Mass Spectrom. Soc. Jpn., vol. 55, No. 5, 2007.

Zubarev, R., 'Electron-capture dissociation tandem mass spectrometry', Current Opinion in Biotechnology, 2004, 15:12-16.

Zubarev, Roman A., "Reactions of Polypeptide Ions with Electrons in the Gas Phase", Mass Spectrometry Reviews, 2003, 22, 57-77.

European Search report corresponding to EP Application No. EP 13829969 dated Jun. 13, 2016.

* cited by examiner

PRIOR ART

PRIOR ART

RADIO-FREQUENCY-FREE HYBRID ELECTROSTATIC/MAGNETOSTATIC CELL FOR TRANSPORTING, TRAPPING, AND DISSOCIATING IONS IN MASS SPECTROMETERS

RELATED APPLICATIONS

This application this application is a continuation of U.S. application Ser. No. 14/201,019, filed Mar. 7, 2014, which is a continuation of U.S. application Ser. No. 12/995,400, filed Jun. 17, 2011, which is a 371 application of International Application No. PCT/US2009/045591 filed May 29, 2009, which claims the benefit of priority of U.S. Provisional Application No. 61/057,770, filed on May 30, 2008 and 61/120,365, filed on Dec. 5, 2008, the entire contents of which application(s) are incorporated herein by reference.

FIELD

The disclosure pertains to devices for trapping charge particles in mass spectrometers.

BACKGROUND

Mass spectrometry comprises a broad range of instruments and methodologies used to elucidate the structural and chemical properties of molecules, to identify the atoms and molecules that compose samples of physical and biological matter, and to quantify the atoms and molecules identified in such samples. Mass spectrometers can detect minute quantities of pure substances (on the order of or less than $10^{-15}$ g) and, as a consequence, can identify compounds at very low concentrations (on the order of or less than one part in $10^{12}$) in chemically complex mixtures. The power of this analytical technique is evidenced by the fact that mass spectrometry has become a necessary adjunct to research in every division of natural and biological science and provides valuable information to a wide range of technologically based professions (e.g., medicine, law enforcement, process control engineering, chemical manufacturing, pharmacy, biotechnology, food processing and testing, and environmental engineering). In these applications, mass spectrometry is used to identify structures of biomolecules (such as carbohydrates, nucleic acids and steroids); to sequence biopolymers (such as proteins and oligosaccharides); to diagnose disease; to determine how drugs are used by the body; to perform forensic analyses (e.g., determine the presence and quantities of drugs of abuse); to assay environmental samples for pollutants; to determine the age and origins of geochemical and archaeological specimens; to identify and quantify components of complex organic mixtures; and to perform elemental analyses of inorganic materials (e.g., minerals, metal alloys, and semiconductors).

A mass spectrometer typically comprises an ion source, a mass analyzer, a detector, and a data handling system. The ion source's task is to convert atoms and molecules into gas-phase ions so they can be transported through the instrument under the action of electric and magnetic forces. Ions are transferred from the ion source into the mass analyzer where they are dispersed according to their mass-to-charge (m/z) ratios or a related mechanical property, such as velocity, momentum, or energy. At present, the most widely used types of mass analyzers are magnetic sectors, quadrupole mass filters, quadrupole ion-traps, time-of-flight tubes, and Fourier transform ion cyclotron resonance (FT ICR) cells. After the mass analyzer separates the ions, they interact with the detector to generate current or voltage signals, either of which has a magnitude proportional to the number of ions that produced it. These electrical signals, whatever their form, can be continuously processed, stored, and displayed on a monitor over the course of an analysis by a computerized data system; at the end of the analysis, they can be printed out on paper as a graph of signal intensity versus m/z, i.e. as a mass spectrum. In principle, the pattern of ion-signals that appears in the mass spectrum of a pure molecular substance constitutes a unique fingerprint from which the molecule's mass and various features of its structure can be deduced.

Mass spectrometry can be performed on a molecular sample in multiple, tandem stages to probe incisively into the complexities of molecular structure and to markedly increase specificity and sensitivity in analyses of complex mixtures of molecules. If the sample is a pure compound, a product-ion tandem analysis (FIG. 1A) can provide much additional information about the analyte's structure. If the sample is a mixture of compounds, a precursor-ion tandem analysis (FIG. 1B) can be used to uniquely identify a number of the mixture's molecular components; in this latter application, the procedure substantially increases signal-to-background ratios (and, thus, reduces limits of detection) by eliminating interferences from compounds of noninterest.

A tandem mass spectrometric unit, commonly designated as MS/MS or $MS^2$, comprises two transmission mass analyzers (e.g., magnetic sectors, quadrupole mass filters, time-of-flight tubes, or a hybrid combination of such analyzers) arranged to perform spatially separated mass analyses in sequence (FIG. 1C), a single three-dimensional (3D) trapping mass analyzer (e.g., quadrupole ion-trap or FT ICR cell) that can perform two or more temporally separated mass analyses in sequence (FIG. 1D), or a hybrid arrangement of both transmitting and 3D trapping analyzers. In the first phase of a product-ion tandem mass analysis (precursor selection), a packet of ions of a particular m/z value, which are called precursor ions or precursors, is selected from among all the ions of various masses formed in the source as shown in FIG. 1A. In a transmission instrument, the first analyzer performs this operation, and in a 3D trapping instrument, the analyzer itself performs it. In the first phase of a precursor-ion tandem mass analysis (precursor scan), the precursors are spatially resolved from one another by the first analyzer of a transmission instrument. A precursor-ion analysis cannot be performed on a 3D trapping instrument. In the second phase (fragmentation), the precursor ions are induced to dissociate by a physicochemical process (FIGS. 1A and 1B). In a transmission instrument, this induced fragmentation takes place in a cell located between the two analyzers (FIG. 1B), and in a 3D trapping instrument, it takes place in the mass analyzer itself (FIG. 1C). In the third phase of a product-ion analysis (product-ion selection), the ionic fragments resulting from the dissociation process are resolved into a product-ion mass spectrum (FIG. 1A). In a transmission instrument, the second analyzer performs this operation, and in a 3D trapping instrument, the analyzer itself performs it. In the third phase of a precursor-ion analysis (FIG. 1B), only a certain ionic fragment from the dissociation of a particular precursor is transmitted by the second analyzer of the transmission instrument on which the analysis is being performed. The $MS^2$ sequence can be extended to an $MS^3$ sequence by using the second mass analyzer in a transmission instrument or the second round of mass dispersion in a 3D trapping instrument to select a packet of particular product ions from the preceding fragmentation stage as the precursors for a second level of fragmentation and product-ion analysis. This pattern can be repeated for yet higher orders of tandem analysis ($MS^n$) so long as the number of product ions from a given stage of fragmentation is sufficient to produce an interpretable mass spectrum in the subsequent stage of mass analysis.

A gaseous molecular ion can be decomposed into fragments if its internal energy can be raised sufficiently during an interaction with a physical or chemical agent. The physicochemical processes most commonly used in MS/MS to fragment precursor ions are photon-induced dissociation (PID), low-energy collision-induced dissociation (CID), high-energy CID, electron impact excitation of ions from organic (EIEIO), electron transfer dissociation (ETD), electron capture dissociation (ECD), and electron detachment dissociation (EDD). In current practice, PID, low-energy CID, and high-energy CID are used universally to analyze all types of molecules whereas ETD, ECD, and EDD are used almost exclusively in the analysis of peptides and proteins. ECD, EDD, and ETD exhibit little selectivity for particular amino acids (proline and amino acids associated with disulphide bonds are exceptions); in addition, all three preserve labile post-translational modifications (PTMs), e.g., phosphorylation, o-glycosylation, and n-glycosylation. Consequently, these three dissociation processes are particularly suitable for analyzing peptides having as many as 20-25 amino acids and for determining the sites and nature of PTMs.

Each disassociation process induces fragmentation by forcing transitions in the precursor ions from bonding energy states to antibonding energy states. In PID, infrared photons induce nonpredetermined bonds to break by exciting various rotational and vibrational states, and ultraviolet photons of a specific wavelength induce predetermined bonds to break by exciting particular electronic states. PID requires an arrangement by which the precursor ions can be irradiated with an intense beam of photons; using a laser as the light source and an arrangement of common optical components, PID can (with little difficulty) be made to take place in any type of transmission dissociation cell or 3D analyzer. In CID, gas-phase collisions between precursors and inert atoms (like helium) or molecules (like nitrogen) induce nonpredetermined bonds to break by exiting various rotational, vibrational and electronic states. Low-energy CID and high-energy CID alike require that the precursor ions be intimately confined with the collision gas at a relatively high pressure. In current practice, low-energy CID is carried out most efficiently in 2D RF-multipole (e.g., quadrupole, hexapole, or octapole) ion-guides or 3D RF-trapping analyzers (e.g. quadrupole ion-traps or FT ICR cells), and high-energy CID is carried out in electric and magnetic field-free transmission cells designed to differentially maintain the collision gas at a relatively high pressure.

In ETD, exothermic single-electron-transfers from anions (which function both as bases and one-electron reducing agents) to multiply protonated peptidic precursors induce cleavage almost exclusively of the peptides' N—$C_a$ (amine) backbone-bonds by exciting electronic states associated with the latter. ETD requires that the cationic precursors be intimately confined in space and time with anionic reagent molecules; this condition can be achieved in the 2D RF field of a linear multipole ion guide by applying a secondary RF-voltage to the multipole's end lenses. In ECD, exothermic single-electron-captures of free, low-energy (on the order of 1 eV for "normal" ECD and 20 eV for "hot" ECD) electrons by multiply protonated (cationic) peptidic precursors induce the peptides' N—$C_a$ backbone-bonds to break by almost exclusively exciting electronic states associated with the latter. In EDD (the negative-ion counterpart to ECD), single-electron-captures of free, moderately low-energy (on the order of 20 eV) electrons (which in each anion results in the creation of a positive-radical or hole that exothermically recombines with one of the anion's negative charges) induce the peptides' inter-residue bonds to break by almost exclusively exciting electronic states associated with the latter. ECD and EDD require that the precursor ions be forced to mingle with a dense population of low-energy electrons. Since the reagent electrons and the multiply protonated precursor ions have opposite polarities and masses that differ by more than six orders of magnitude, the conditions for simultaneously confining them in the same volume of space cannot be satisfied in a purely electrostatic cell, and can only be minimally satisfied in an RF cell. To date, the only instrument in which it has been possible to achieve this condition to any practical degree has been the FT ICR mass spectrometer.

Since its advent in 1998, electron capture dissociation (ECD) has come to be regarded as a potentially powerful tool for elucidating protein structure. Numerous efforts to optimize ECD for protein analysis have been reported over the past decade. Less publicized has been a small number of recent attempts to overcome the limitation of ECD's original implementation, namely, the necessity for practical purposes of having to perform it on FT ICR instruments. Several researchers have independently succeeded in observing ECD in a linear ion trap, a three dimensional (3D) ion trap, and a digital 3D ion trap. (Baba et al., Anal. Chem. 2004, 76: 4263; Satake et al., Anal. Chem. 2007, 79: 8755; Silivra et al., J. Am. Soc. Mass Spectrom. 2005, 16: 22; Ding et al., Anal. Chem. 2006, 78: 1995.) In the first two of these demonstrations, magnetic fields were used for electron confinement, and in the last one, a digitally generated, rectangular-trapping, electric-field waveform was used for this purpose. In all three approaches, it was necessary to use a moderating gas (He) either to convert some of the electrons' translational energy into rotational energy about the magnetic field lines, to compensate for the unavoidable transfer of energy from the RF field to the electrons, or both. In the two 3D ion-trap demonstrations, ECD occurred in the analyzer itself, whereas in the linear ion-trap demonstration, it took place in a custom-designed cell. By virtue of being analyzer-independent, the linear multipole would seem to be a more promising platform than the 3D ion trap.

In any of the configurations described above, ions are vulnerable to losses in a mass spectrometer as they are transported from the ion source to the mass analyzer or between two mass analyzers. Electrostatic lenses, radio-frequency (RF) multipoles, and combinations of both are typically used to avoid or mitigate such losses. Unfortunately, the devices are complex, expensive, and frequently can be configured for only a limited range of applications. For example, conventional devices typically cannot be conveniently reconfigured to use a different dissociation process. In addition, in RF-field based devices, beam energy control is difficult because of beam interaction with the RF field. Beam losses are also high due to the dependence of beam propagation on the phase of the applied RF field. Thus, improved devices are needed to transport, trap, and dissociate electrically charged, gas-phase molecules (ions).

SUMMARY

An exemplary mass spectrometry apparatus in accordance with the present invention comprises, from a first end to a second end along an axis, a first conductive aperture coupled to receive a first electrical potential, a first magnetostatic lens, and a second conductive aperture coupled to receive a second electrical potential, wherein the first and second conductive apertures and the magnetostatic lens define a charged particle interaction cavity that extends along the axis. According to some exemplary configurations, the first magnetostatic lens comprises, from the first end to the second end along the axis, a first pole piece, a magnet, and a second pole piece, wherein the first pole piece and the second pole piece are magnetically coupled to the magnet. In additional configurations, the first conductive aperture and the second conductive aperture are defined by the first pole piece and the second pole piece, respectively. In some configurations, the first magnet is a permanent magnet or an electromagnet. In other configurations, the first and second conductive apertures are circular. In additional configurations, the first and second conductive apertures are non-circular. In other embodiments, the axis includes a straight line portion and/or a curved portion. In still further configurations, a second magnetostatic lens is situated adjacent the second conductive aperture and a third conductive aperture is configured to receive a third electrostatic potential.

In other embodiments, mass spectrometry apparatus of the present invention comprises a plurality of magnetostatic lenses situated along an axis and a plurality of electrostatic lenses interleaved with the magnetostatic lenses. The plurality of magnetostatic lenses and the plurality of electrostatic lenses define an interaction cavity situated along the axis in which charged particles are in at least at some regions of the interaction cavity simultaneously responsive to both a magnetic flux produced by at least one of the magnetostatic lenses and an electric field produced by at least one of the electrostatic lenses. In other configurations, the plurality of magnetostatic lens further comprises respective magnets and pole pieces, and the electrostatic lenses are defined at least in part by the magnets or the pole pieces of the plurality of magnetostatic lenses.

In yet a further aspect of the present invention, exemplary electrostatic/magnetostatic charged particle guides are provided which comprise a first magnetostatic lens including a first pole piece, a first insulator, a first magnet, a second insulator, and a second pole piece, wherein the first magnetostatic lens defines a first lens aperture situated on the axis and wherein the first and second insulators are configured to electrically insulate the first magnet from the first and second pole pieces. A first electrical connector is coupled to the first pole piece. In other configurations, charged particle guides include a second magnetostatic lens situated adjacent the first magnetostatic lens and that includes a third insulator, a third pole piece, a second magnet, a fourth insulator, and a fourth pole piece. The third insulator is configured to electrically insulate the second magnet from the third pole piece, and the fourth insulator is configured to electrically insulate the fourth pole piece from the second magnet. In some configurations, the first magnet and the second magnet are magnetic rings. In further configurations, the second pole piece and the third pole piece are formed as a common pole piece situated between and magnetically coupled to the first magnet and the second magnet.

Still further the present invention provides an exemplary apparatus that comprises a plurality of magnetostatic lenses periodically situated along an axis and one or more conductive aperture plates situated on the axis and associated with the plurality of magnetostatic lenses, wherein the conductive aperture plates are electrically isolated from each other. As used herein, the term "conductive aperture plate" refers to both the aforementioned pole pieces and to components comprising a non-magnetic, conducting material but otherwise similar to the pole pieces. A plurality of electrical connectors is provided that are independently electrically coupled to respective conductive aperture plates. Thus, the term "conductive apertures" include apertures that are defined by at least portions of magnets of the plurality of magnetostatic lenses, pole pieces, or non-conductive plates having at least partial conductive coatings. In further configurations, the conductive apertures are defined by an electrically conductive coating on an insulating substrate.

In another of its aspects, the present invention provides an apparatus that comprises a plurality of magnetostatic lenses having alternate polarities as situated along an axis and a plurality of conductive aperture plates situated along the axis and interleaved with the magnetostatic lenses, wherein each of the conductive aperture plates is configured to be coupled to a respective voltage. In additional configurations, each of the plurality of the conductive aperture plates is formed of a ferromagnetic material and is magnetically coupled to a respective magnet.

Exemplary methods of the present invention include providing a charged particle beam to at least one magnetostatic lens interleaved with at least one electrostatic lens, wherein the magnetostatic lens is configured to produce a static magnetic field that directs the charged particle beam along an axis. At least first and second electrical potentials configured to trap, accelerate, decelerate, or focus the charged particle beam with the electrostatic lens are selected and applied. In other configurations, the static magnetic field is selected to focus the charged particle beam along the axis or to direct the charged particle beam along a sinusoidal path along the axis. In further configurations, the first and second electrical potentials are selected to substantially trap at least a portion of the charged particle beam. In other representative configurations, the charged particle beam is provided to a plurality of magnetostatic lenses interleaved with at least one electrostatic lens or a plurality of electrostatic lenses.

These and other features and aspects of the disclosed technology are set forth below with reference to the accompanying drawings.

DETAILED DESCRIPTION

Figure 1A:
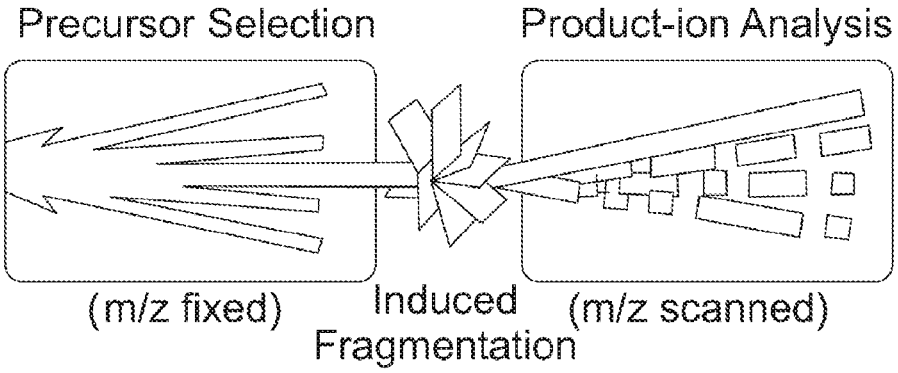
Fig. 1A PRIOR ART
FIGS. 1A-1B schematically illustrate two modes of tandem mass spectrometry.
Figure 1B:
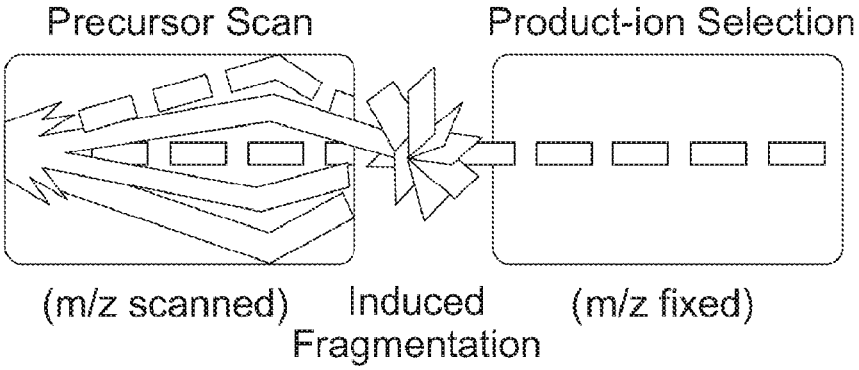
Figure 1C:
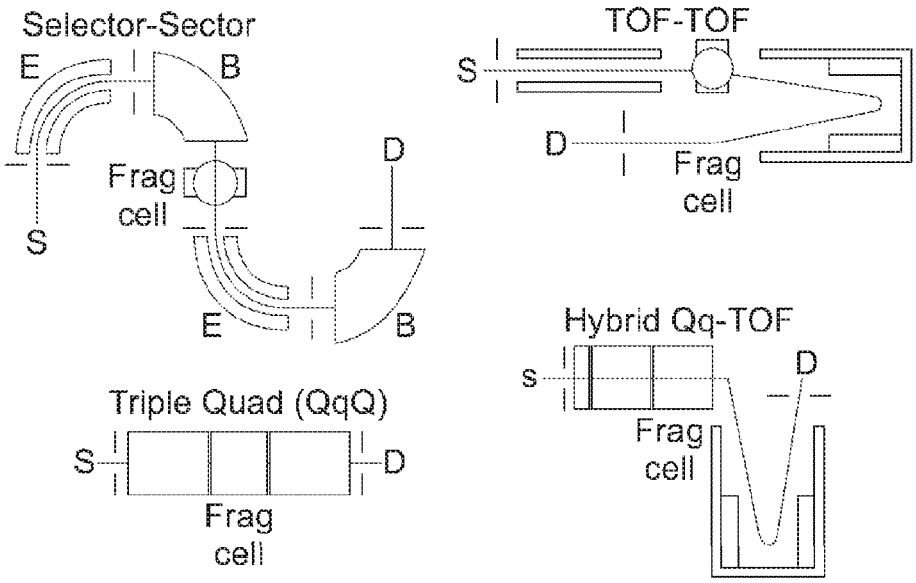
Fig. 1C PRIOR ART
FIGS. 1C-1D schematically illustrate representative tandem mass spectrometer configurations in which the disclosed devices can be used or substituted for conventional devices used as fragmentation or dissociation cells.
Figure 1D:
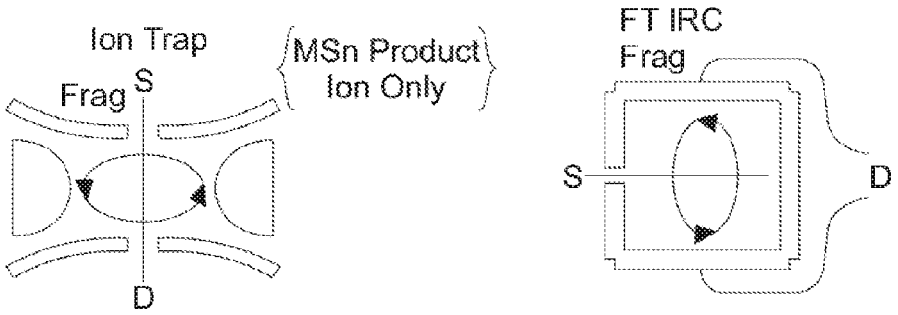

As used in this application and in the claims, the singular forms "a," "an," and "the" include the plural forms unless the context clearly dictates otherwise. Additionally, the term "includes" means "comprises."

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

Theories of operation, scientific principles, or other theoretical descriptions presented herein in reference to the apparatus or methods of this disclosure have been provided for the purposes of better understanding and are not intended to be limiting in scope. The apparatus and methods in the appended claims are not limited to those apparatus and methods which function in the manner described by such theories of operation.

Magnetostatic lenses can have high transmission efficiencies and are routinely employed in (for example) electron microscopes, linear accelerators, and traveling wave tubes, but have not been adapted for mass spectrometry, largely because they have and continue to be viewed as unsuitable for this application. Surprisingly, as disclosed herein, contrary to this conventional wisdom, the present inventors have discovered and demonstrated that permanent magnet based systems (and other systems using static magnetic fields) provide numerous unexpected advantages. For example, conventional electrostatic and RF-driven devices for transporting, trapping, and dissociating ions in mass spectrometers must generally be precisely configured based on the type of mass analyzer used. Thus, while conventional devices limit the types of analyses that can be performed, often requiring substantial instrumental reconfigurations to change the nature of an analysis, the disclosed devices can be simply reconfigured or, in some cases, be preconfigured to accommodate a variety of analyses.

In contrast to conventional devices, ion beams with kinetic energies up to 5 keV or larger are focused along a magnetic lens axis and can be transported with low loss. Because electrostatic and magnetostatic fields have no phases, particle beams entering such fields suffer almost no losses. Thus, the disclosed devices permit higher transmission efficiencies and lower detection limits than conventional devices.

In the exemplary configurations disclosed herein, magnetostatic devices include permanent magnets (e.g., magnets 208, 250, 610-616, 750 of FIGS. 2A-2E) that provide static magnetic flux densities that are generally between about 0.01 T and 1.0 T, but smaller or larger flux densities can be used. For a given geometry, flux densities can be selected to provide suitable charge particle trapping and/or transport, and in some cases, to maximize trapping and/or transport such that a substantial portion of a charged particle beam can be available for gas phase reactions, delivered to an analyzer, or otherwise retained or delivered for analysis or additional reactions. Magnetic flux densities can be selected based on, for example, the availability, cost, and mechanical characteristics of permanent magnets. Permanent magnets having magnetic flux densities of between about 0.01 T and 1 T are readily available in a variety of sizes and shapes at moderate costs.

Disclosed herein are representative components of mass spectrometers that are configured to transport, trap, and/or fragment ions based on a series of superimposed electrostatic lenses (e.g., lenses 312-316, 410-415 of FIGS. 3B, 4) and magnetostatic lenses (e.g., lenses 302, 304, 460-464 of FIGS. 3B, 4) that are generally situated along a linear axis or a curved axis such as a section of a circle, ellipse, or other curve, or combinations of line segments and curved arcs. In some disclosed exemplary configurations, the superimposed electrostatic lenses (e.g., lenses 410-415 of FIG. 4) and magnetostatic lenses (e.g., lenses 460-464 of FIG. 4) are periodically arranged with a fixed period along an axis 408, but in other exemplary configurations, a variable period such as a period that increases, decreases, or alternately increases and decreases along the axis is used. In typical exemplary configurations, the superimposed electrostatic lenses 410-415 and magnetostatic lenses 460-464 are interleaved or otherwise associated with a series of permanent magnets (e.g., magnets 402-406) or electromagnets, and magnetic pole pieces (e.g., pole pieces 410-415) associated with the magnets are electrically insulated from the magnets in order to serve as electrostatic lens elements 410-415. It will be appreciated that the disclosed embodiments are illustrative and not to be taken as limiting the scope of the disclosure or the claimed subject matter. For example, in each of the configurations presented herein, some or all of the magnetic poles pieces may be replaced by pieces formed of a non-magnetic, conductive materials (conductive aperture plates) to provide the electrostatic lens elements.

In convenient configurations, the disclosed cells (e.g., cells 600, 700 of FIGS. 2D, 2E) are based solely on a periodic arrangement of magnetostatic lenses (e.g., lenses 640, 740) and, in these configurations, radiofrequency fields are not needed. However, conventional devices based on RF fields can be used in concert with the disclosed devices. The disclosed devices can be configured to transport, trap, or transport and trap ions, electrons, or both in mass spectrometers, regardless of type, by electrically insulating iron pole pieces (e.g., pole pieces 602-609, 754-756) that separate the periodically arranged magnets (e.g., magnets 610-616, 750) and connecting each or some pole pieces to suitable electrical potentials using one or more power supplies or a resistive voltage divider. In other configurations, the disclosed devices can be configured to transport, trap, or transport and trap ions, electrons, or both in mass spectrometers, regardless of type, with a series of magnetic lens elements with different bore sizes and shapes such as a triangle, rectangle, oval or other shapes that include linear and/or curved portions.

In other configurations, the disclosed devices can be configured to transport, trap, or transport and trap molecular ions in conjunction with fragmentation in tandem mass spectrometers, regardless of type. For photon-assisted dissociation (PID), this can be accomplished by providing one or more apertures to introduce a dissociating light beam, typically a laser beam, to a common location with at least a portion of an ion beam. The apertures can be provided as one or more bores in one or more of the conductive aperture plates and/or soft iron pole pieces. Alternatively, such apertures can be provided in magnets, or other components. Lenses, prisms, and mirrors, or combinations thereof can be arranged to deliver the light beam to the common location. The disclosed devices can be adapted for low- or high-energy collision-induced dissociation (CID) by providing a conduit for introduction of a neutral gas. Such a conduit can be provided by drilling a hole or holes through one or more of soft iron spacers, directing a gas line or gas lines of any sort into either or both ends of the cavity, or by any combination thereof.

Electron-transfer dissociation (ETD) or other charge-transfer-induced dissociation processes can be implemented by providing for anions or cations to be introduced into the cavity by, for example, situating a chemical ionization source or other type of ion source at either end or both ends of a device. Electron-capture dissociation (ECD), electron-detachment dissociation (EDD), electron impact excitation of ions from organic (EIEIO), or other electron-induced processes can be implemented by providing for electrons to be introduced by one or more electron sources situated at either end or both ends of a device cavity.

In this description, devices that provide combinations of electric fields and magnetic fields that are configured to trap or transport charged particles such as ions, electrons, or other charged particles, or charged-particle beams are referred to, for convenience, as "ion guide" apparatus. In some configurations, such ion guides can include features for production of charged particles by one or more dissociation techniques, or can include one or more assemblies configured to produce dissociation. Representative configurations that are substantially cylindrical are described, but the ion guide can have square, ovoid, or other cross-sections and circular cross-sections are selected for convenient illustration. For simplicity, the disclosed exemplary configurations are based on ring-shaped permanent magnets, but other shapes can be used. In other exemplary configurations, electromagnets could be used.

Figure 2A:
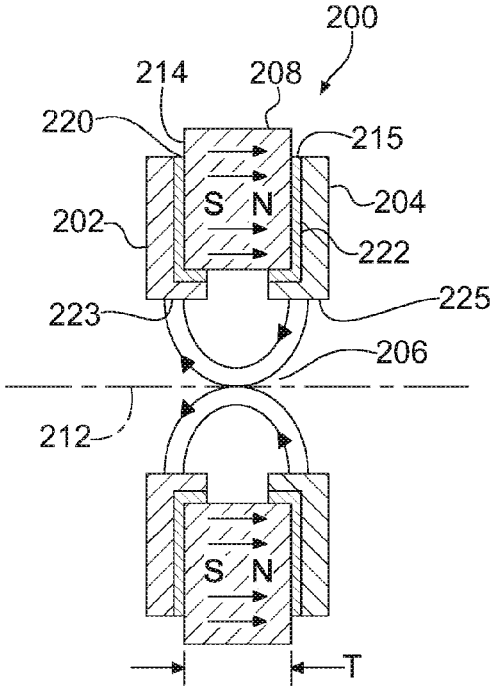
FIGS. 2A-2B schematically illustrate cross-sectional side-views of representative magnetostatic lenses for use in the present invention configured for axial and radial focusing, respectively, having electrically isolated pole pieces.

Referring to FIG. 2A, a magnetic lens 200 comprises soft iron pole pieces 202, 204 situated on either side of a hole 206 in a permanent ring magnet 208 and along an axis 212. With a magnet having a first surface 214 corresponding to a south pole, and an opposite surface 215 corresponding to a north pole, axial focusing is provided. Electric insulators 220, 222 are provided so that electrical potentials can be applied independently to the soft iron pole pieces 202, 204, without applying a potential directly to the magnet 208. The pole pieces 202, 204 may be provided in the form of a generally circular plate having a central aperture that coincides with the central aperture of the ring magnet 208. The pole pieces 202, 204 desirably include cylindrical flanges 223, 225 that extend into the aperture of the ring magnet 208, with each flange 223, 225 extending into the magnet aperture a distance of one third of the thickness, T, of the ring magnet 208.

Figure 2B:
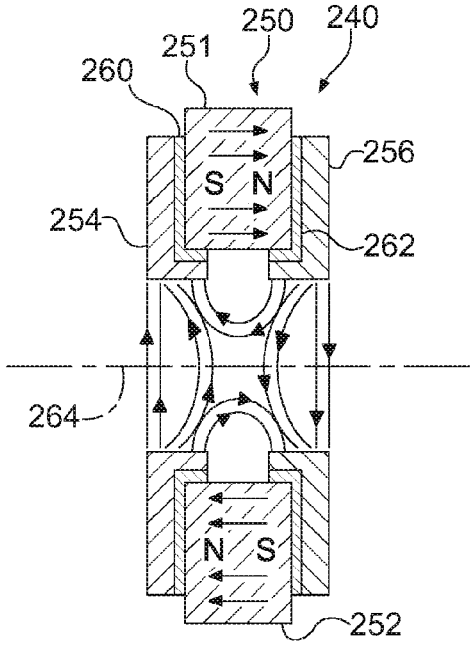

In the configuration shown in FIG. 2B, a ring magnet 250 is radially segmented about an axis 264 and comprises a first segment 251 polarized with a first polarity and a second segment 252 polarized with an opposite polarity, though more than two segments may be used, so as to provide a magnetic lens 240 that provides radial focusing. The magnetic lens of FIG. 2B also includes electric insulators 260, 262 that electrically insulate pole pieces 254, 256 from the magnet 250. Periodic arrangements of devices such as shown in FIGS. 2A-2B are illustrated in FIGS. 2D-2E. Alternatively, the magnets 250, 750 may be provided in the form of Halbach array. In the configuration of FIG. 2D, focusing is axial, and charged particles tend to be directed toward an axis 270 within cavity 619. In the configuration of FIG. 2E, focusing is radial, and charged particles tend to follow sinusoidal paths about an axis 272 within cavity 716.

The periodic focusing arrangements of FIGS. 2D-2E are illustrated along linear axes 270, 272, but in other configurations can be arranged along curved axes. Magnets 610-616, 750 that provide magnetic flux densities of between about 0.01-1.5 T can be used in most applications, and voltages of up to at least 5 kV can be applied to the pole pieces 602-609, 754-756 to realize hybrid segmented-electrostatic-focusing/strong-periodic-magnetostatic-focusing devices that can transport and trap ions and electrons that have kinetic energies commonly found in mass spectrometers. For applications that require or might benefit from nonlinear electrostatic/magnetostatic focusing (e.g., collisional cooling, ion mobility spectrometry, or gas-phase chemistry), magnetic lens elements 640, 740 with different bore sizes can be provided and arrayed symmetrically or asymmetrically to define a charged particle propagation cavity that is conical, hour-glass shaped, or has some other shape. Finally for multi-stage tandem mass spectrometry ($MS^n$) experiments, provisions for exposing the ion beam in the cavity 616, 716 to fragment-inducing agents (e.g., photon beams, electrons, fast ions, or fast atoms, gases of neutral atoms, reagent ions) can be added to either a linear or curvilinear hybrid electrostatic/magnetostatic structure.

For most $MS^n$ experiments, electric field strengths less than about 5,000 V/cm (the highest likely to be used) and magnetic flux densities on the order of 5 T do not affect either photons or electrically neutral gases. Thus, for PID and CID experiments, photons or neutral gases can be readily introduced into cells that use such field strengths to trap and transport charged particles.

In the following, two representative configurations of such structures are described. In these configurations, components are situated along linear axes 306, 408 and magnets 308, 310, 402-406 are oriented so as to provide axial focusing, FIGS. 3B, 4. As noted previously, other configurations can be used and the particular configurations described below are selected for convenient illustration.

Figure 3A:
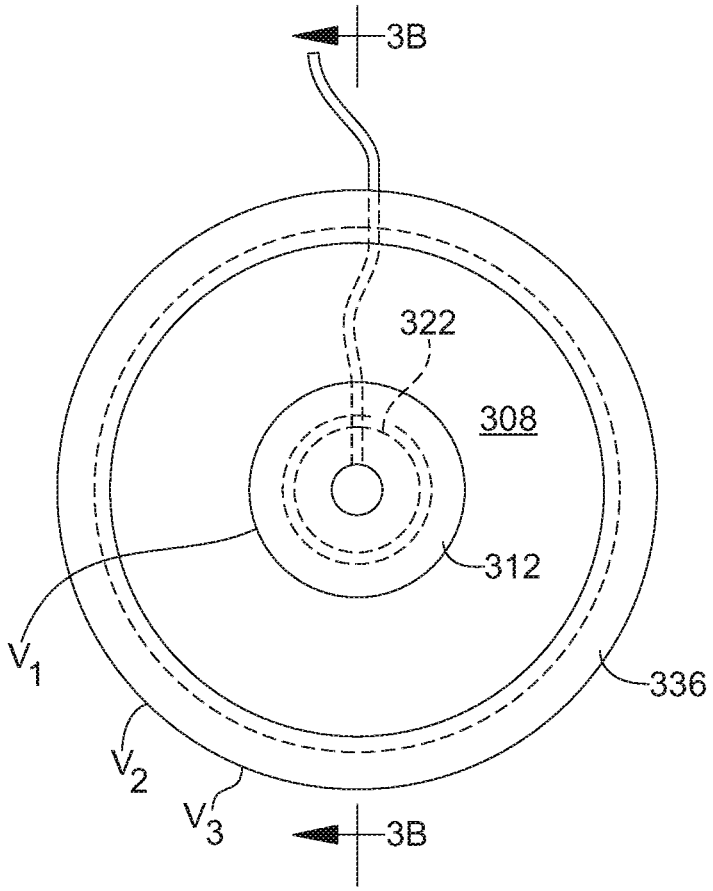
FIGS. 3A-3B schematically illustrate end and cross-sectional side views, respectively, of an exemplary hybrid (radio-frequency-free) electrostatic/magnetostatic charged particle guide of the present invention that includes two magnetic lenses and in which accelerating/decelerating/trapping electrical potentials are applied to magnetic lens pole pieces.
Figure 3B:
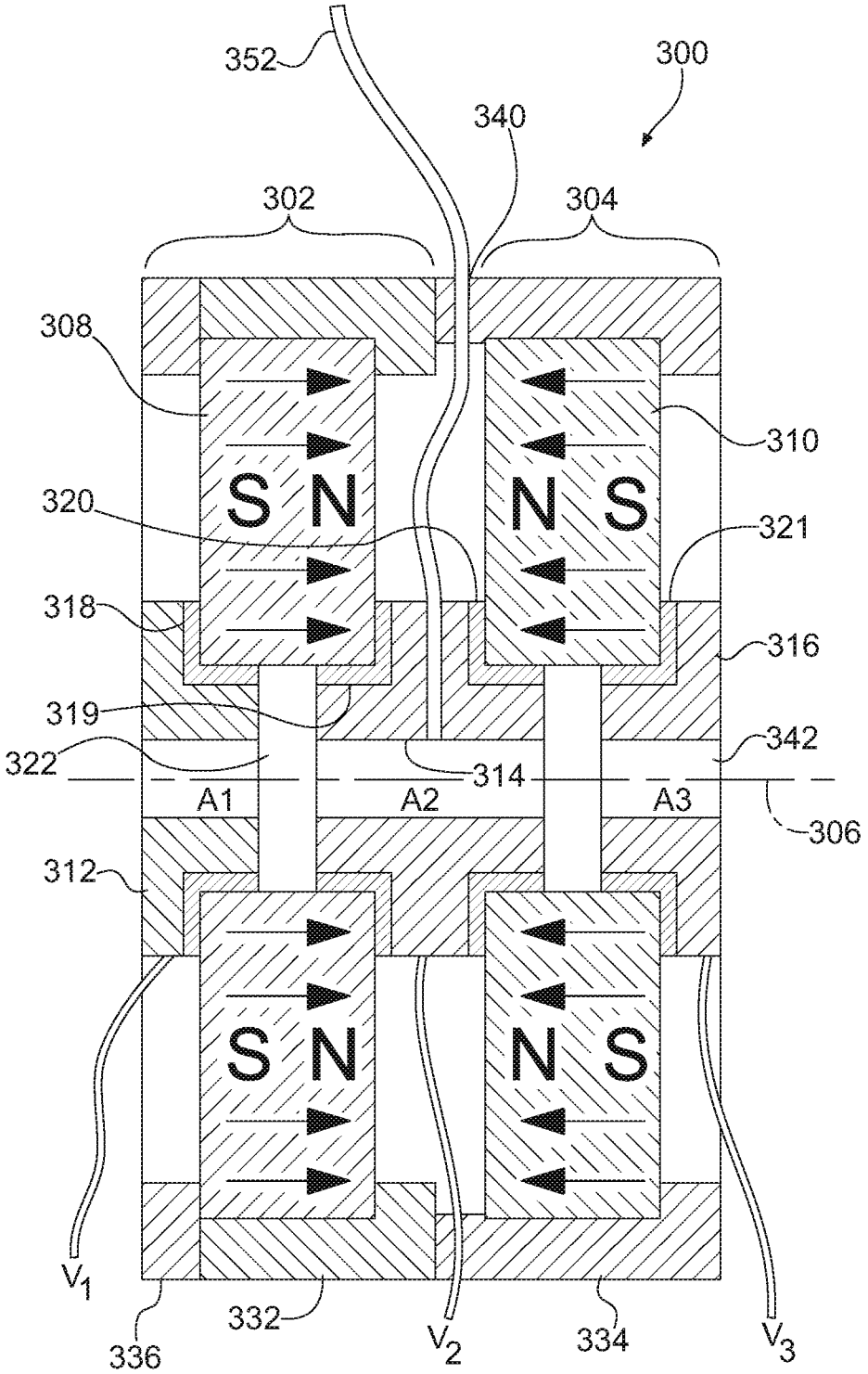

With reference to FIGS. 3A-3B, a representative ion guide or cell 300 comprises magnetic lenses 302, 304 that are situated along an axis 306. The magnetic lenses 302, 304 comprise magnets 308, 310, respectively, that are arranged with like poles facing each other to provide axial focusing, although in other configurations, different arrangements can be used. The pole pieces 312, 314, 316 are electrically separated from the magnets 308, 310 by electric insulators 318-321 so that the pole pieces 312, 314, 316 can be coupled to different electrical potentials $V_1$, $V_2$, $V_3$, (or $V_{1-6}$, of FIG. 4), for example. (Alternatively or in additional to the insulators 318-321, the magnets 308, 310 may comprise a non-conductive material, such as a ceramic, for example.) Typically, these voltages $V_1$, $V_2$, $V_3$ (or $V_{1-6}$) are static, but time-varying voltages $V_1$, $V_2$, $V_3$ (or $V_{1-6}$) can be applied to retard, accelerate, capture, or otherwise manipulate charged particles in an inner cavity 342 defined by the inner bores of the magnets 302, 304 and the pole pieces 312, 314, 316. The pole pieces 312, 314, 316 are generally formed of soft iron or other magnetic material and provide conductive apertures $A_1$, $A_2$, $A_3$. As shown in FIGS. 3A-3B, the magnetic lenses 302, 304 share the pole piece 314, but in other configurations, separate pole pieces can be provided.

In the configuration of FIGS. 3A-3B, the magnets 308, 310 are formed as rings that include a central bore 322 that is aligned with the axis 306. In one configuration, the magnets 308, 310 are axially polarized N42SH-grade Nd—Fe—B ring-magnets (SuperMagnetMan, Birmingham, Ala. USA) that are about 3.0" in diameter, 0.5" thick, and have a 0.375" bore. The magnets 308, 310 are arranged in an alternating-polarity-structure similar to that of an axial traveling wave tube (TWT). The magnets 302, 304 are fixed in position with aluminum casing members 332, 334 that can be secured to each other with screws or other fasteners. An end plate 336 is provided for the magnet 302. As shown in FIG. 3B, an inlet 340 is provided for introduction of a gas to the inner cavity 342 so that the ion guide 300 can be configured for CID. Pole pieces can also be provided and electrically insulated from one or both of the magnets 308, 310.

Figure 4:
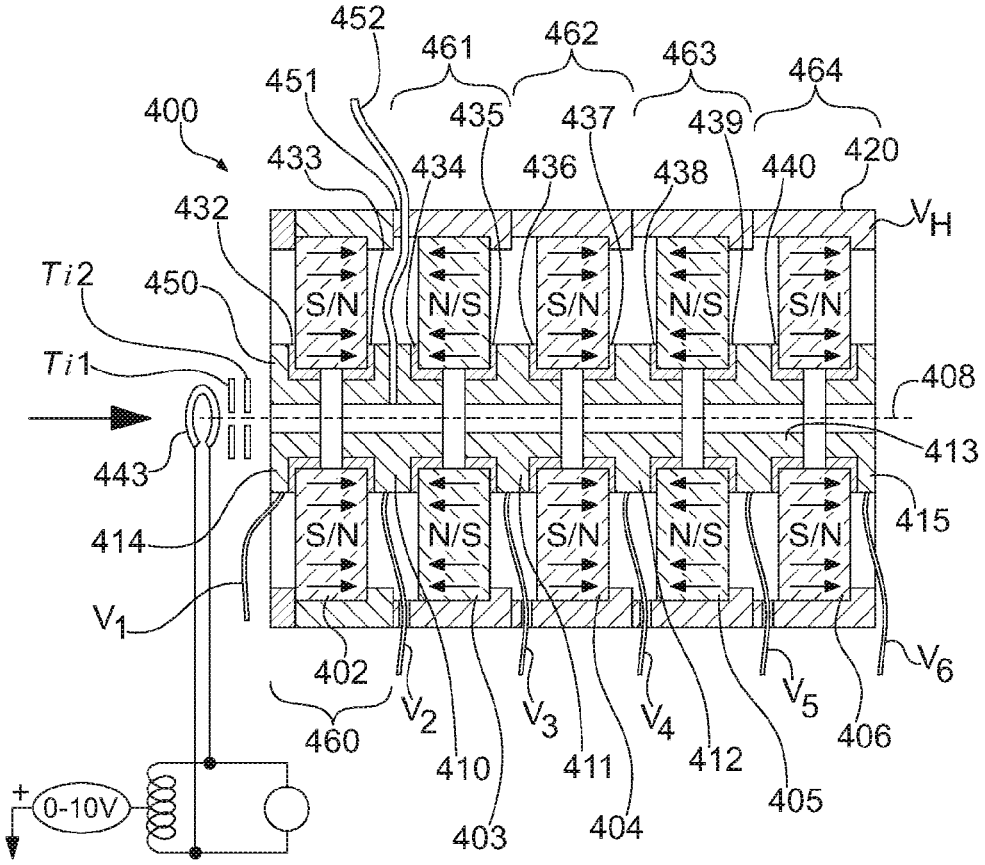
FIG. 4 schematically illustrates a cross-sectional side-view of an exemplary hybrid electrostatic/magnetostatic charged particle guide of the present invention that includes five magnetic lenses in which accelerating/decelerating/trapping electrical potentials are applied to magnetic lens pole pieces.

With reference to FIG. 4, an ion guide 400 includes magnets 402-406 that are situated along an axis 408. Soft iron rings 410-413 are situated between the magnets, and soft iron rings 414-415 are situated at ends of a housing 420 that retains the magnets 402-406. Electric insulator rings 432-441 are situated between the magnets 402-406 and the soft iron rings 410-415 so that electrical potentials can be independently established on one or more or all of the soft iron rings 410-415. (Alternatively or in additional to the insulator rings 432-441, the magnets 402-406 may comprise a non-conductive material, such as a ceramic, for example.) In one configuration, the insulator rings 432-441 are made of a poly(tetrafluoroethene) or poly(tetrafluoroethylene) (PTFE) and have a thickness of about 0.010". Each of the soft iron rings 410-415 can be connected to an independently adjustable, floating power supply that can supply a voltage in a range of 0 up to ±5000 V, or other bipolar or unipolar voltage range. In some configurations, time varying voltages are provided. In the configuration of FIG. 4, a ring-shaped filament 443 of tungsten-rhenium wire is located concentrically on the axis 408 near a surface 450 at which ions enter the ion guide 400. In this configuration, the soft iron rings 410-415 serve both as pole pieces for the magnets 402-406 and, depending on the applied voltages, as one or more electrostatic lenses 410-415. The apparatus of FIG. 4 can also be provided with an aperture such as hole 451 drilled radially into one or more of the soft iron rings for introduction of a neutral gas for CID through a pipe or tube 452. A hole through one or more of the soft iron rings 410-415 and the housing 420 can also be provided for introduction of an optical beam such as a laser beam for laser assisted dissociation.

In addition the present invention provides configurations of ion guides/cells with differing locations of the source of electrons. Such configurations can increase the population of low-energy electrons sufficiently to raise the reaction efficiencies of ECD, EDD, or any other electron capture process by one or more orders of magnitude and, thereby, enable users to conduct more comprehensive proteomics experiments.

Figure 10:
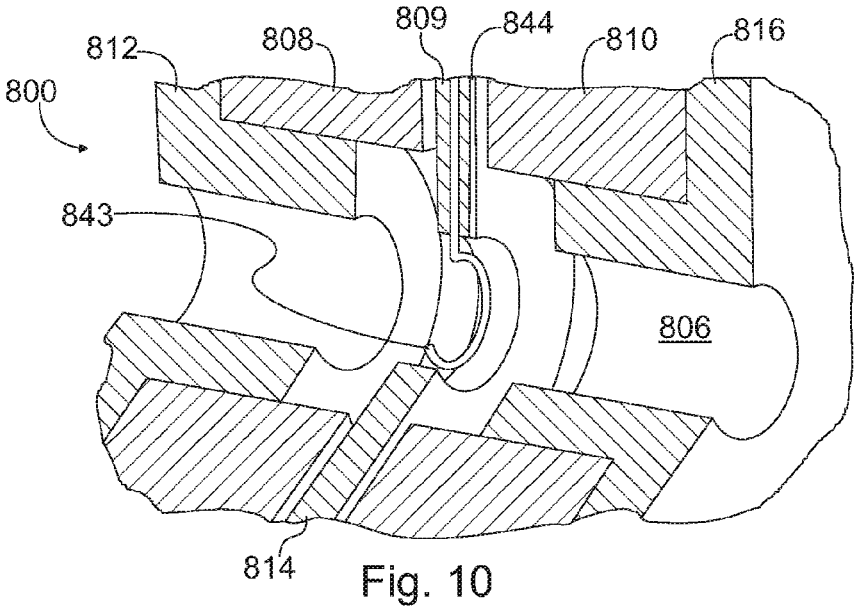
FIG. 10 schematically illustrates a three-dimensional view in partial cross-section of an exemplary hybrid electrostatic/magnetostatic cell of the present invention that includes a thermal electron source inside the cavity.

In this regard, the present invention provides devices that locate the source of electrons, (FIG. 10), such as filament 843 within the cavity 806 of a radio-frequency-free (RFF) hybrid electrostatic/magnetostatic cell or trap 800 for purposes of performing ECD, EDD, or any other electron capture process. As with the cell 300 of FIG. 3B, the cell 800 may include two permanent ring magnets 808, 810 and three soft iron pole pieces 812, 814, 816 arranged in a similar manner to corresponding components of the cell 300. For purposes of illustration, the magnets 808, 810 and pole pieces 812, 814, 816 are shown as being electrically isolated from one another by means of an air gap, however, electrical insulators, such as 0.010" thick poly(tetrafluoroethylene), may be used in place of the air gap and/or the magnets 808, 810 may comprise a non-conductive material, such as a ceramic, for example. The filament 843 may terminate in a circular loop disposed within the cavity 806 of the cell 800 proximate the central pole piece 814. In this regard, a ceramic insulator 809 may be provided on the central pole piece 814 to prevent electrical contact between the filament lead 844 and the pole piece 814.

Figure 14A:
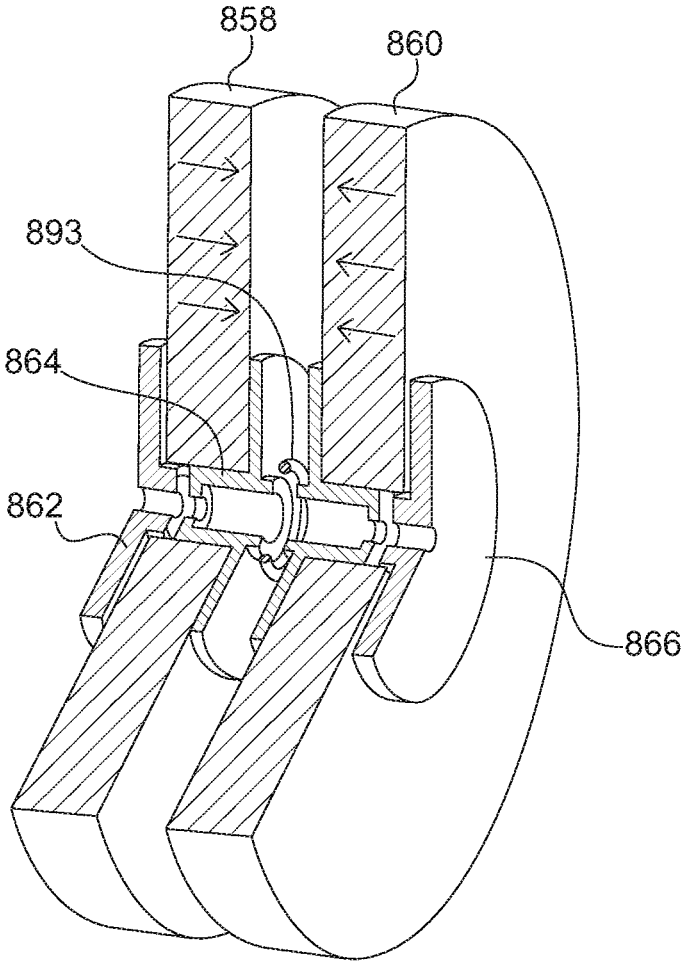
FIGS. 14A-14B schematically illustrate a three-dimensional view AND cross-sectional view of an exemplary hybrid electrostatic/magnetostatic cell of the present invention similar to that of FIG. 10 but having a central non-magnetic conductive aperture plates.
Figure 14B:
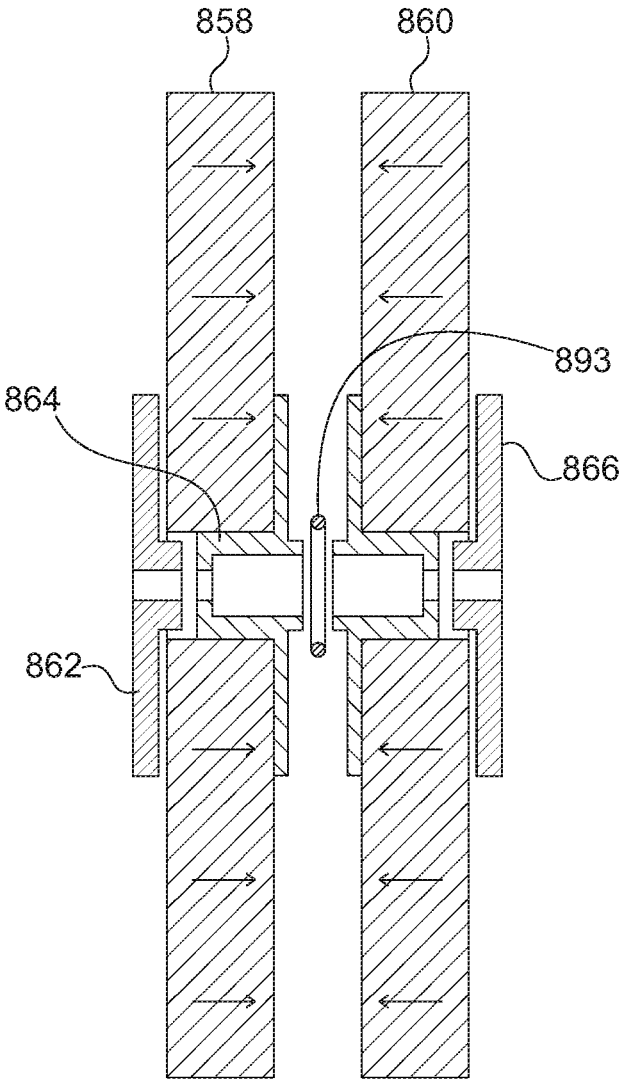

A similar exemplary configuration, is also provided utilizing an internal filament 893, but using two (non-magnetic) conductive aperture plates 864, 865, which may be comprise titanium for instance, in place of the central pole piece 814, to provide conductive apertures, FIG. 14A-14B. Two permanent ring magnets 858, 860, soft iron pole pieces 862, 866 may be arranged in a similar manner to corresponding components of the cell 800. Again, for purposes of illustration, the magnets 858, 860 and pole pieces 862, 866 are shown as being electrically isolated from one another by means of an air gap, however, electrical insulators, such as 0.010" thick poly(tetrafluoroethylene), may be used in place of the air gap and/or the magnets 858, 860 may comprise a non-conductive material, such as a ceramic, for example. The filament 843 may terminate in a circular loop disposed within the cavity 806 of the cell 800 proximate the central pole piece 814. Computer simulation of trajectories of electrons emitted from a ring-filament 893 located inside cell indicates that essentially all of the electrons would be trapped in the magnetic bottle.

Figure 11A:
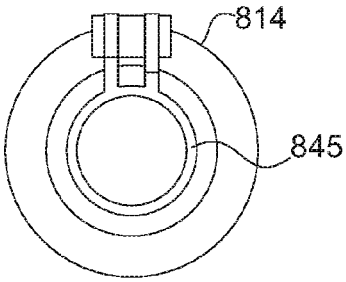
FIGS. 11A-11C schematically illustrate side views of exemplary configurations of internal electronic sources.
Figure 11C:
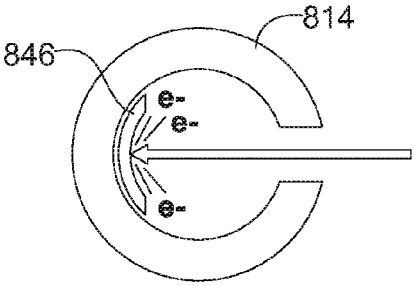
Figure 11B:
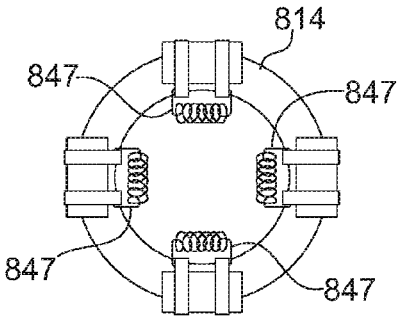

The term "source of electrons" can include any embodiment of an individual electron-source, e.g. thermal source 845 (FIG. 11A) or photoelectric source 846 (FIG. 11B), or multiple electron-sources 847 (FIG. 11C), placed in any geometric orientation or arrangement, i.e. radial or axial, within one or more segments of the cavity of the radio-frequency-free hybrid electrostatic/magnetostatic cells, e.g., cells 300, 400, of the present invention. Locating intense sources of low-energy electrons in the cavity 806 of an electrostatic/magnetostatic cell 800, (FIG. 10), will significantly increase product-ion yields from electron capture reactions to levels that are impossible to attain in RF-based and digital-based cells. This in turn will make it possible to obtain much more information from studies of the energetics and kinetics of electron capture reactions and from tandem mass spectrometric analyses of proteins and peptides.

In addition, in accordance with the present invention, the source of reagent electrons may be located at a position or positions along the side (as opposed to at an end or at both ends) of the hybrid electrostatic/magnetostatic cell to provide greater flexibility in the design and construction of an ECD/EDD cell and, further, to allow an electron monochromator to be used as the source of electrons in order to increase the selectivity of ECD, EDD, or any other electron capture process. Precise control over electron energy used in an ECD experiment makes it possible to exercise a degree of selectivity over how some polypeptides fragment. In those cases where this applies, this phenomenon can be exploited to increase sensitivity. An electron monochromator is any device that can select nearly monoenergetic electrons from the population emitted by a hot metal filament and tune the energy of the selected electrons so that it matches the resonant electron capture energy of any negative ion of interest with an accuracy of better than 0.1 eV.

Figure 9A:
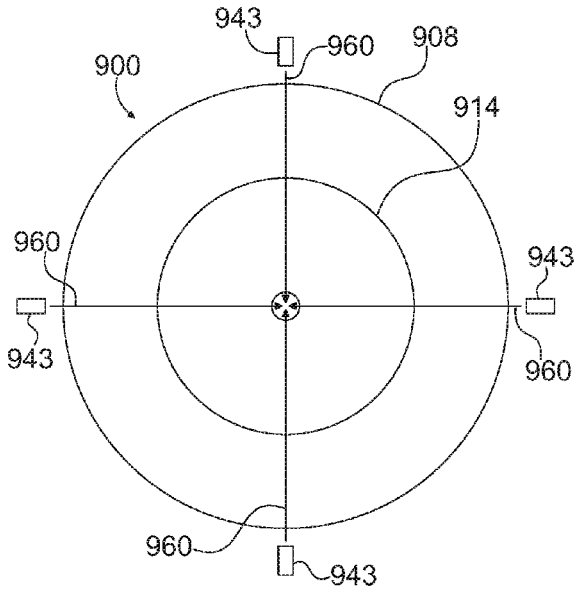
FIG. 9A-9C schematically illustrate an exemplary hybrid electrostatic/magnetostatic cell of the present invention, in side view, cross-sectional view, and three-dimensional view, respectively, that includes thermal electron sources alongside the cell.
Figure 9B:
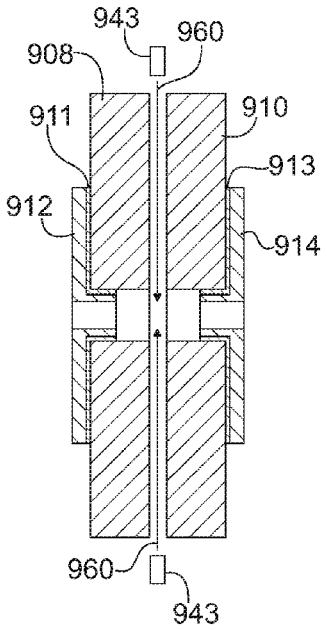
Figure 9C:
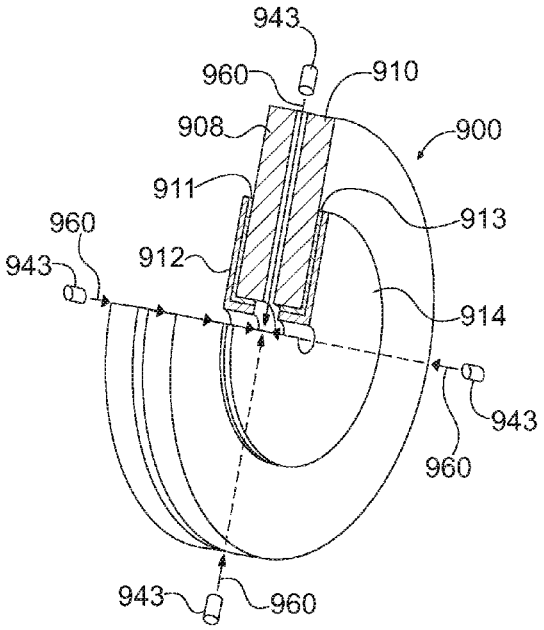

In this regard, the present invention provides devices that locate the electron sources 943 alongside the hybrid electrostatic/magnetostatic cell or trap 900 (FIGS. 9A-9C). As with the cell 300 of FIG. 3B, the cell 900 may include two permanent ring magnets 908, 910 and two soft iron pole pieces 912, 914 disposed on opposing ends of the cell 900 in a similar manner to corresponding components of the cell 300. The pole pieces 912, 914 are electrically isolated from the magnets 908, 910 electrical insulators 911, 913, such as 0.010" thick poly(tetrafluoroethylene). In this configuration, electrons may be admitted from the external source 943 into the hybrid electrostatic/magnetostatic cell 900 through a radial port in the wall of the cell 900, FIGS. 9A-9C. The source(s) 943 may be mounted either outside or inside the periphery of the hybrid cell 900 along any radius that passes between two magnets 908, 910. The electron source 943 can include any nonmonochromatic, or monochromatic, embodiment of a thermal electron-source or electron-sources, placed in any geometric orientation or arrangement about the periphery within one or more segments of the cavity of any of the configurations of the hybrid electrostatic/magnetostatic cell of the present invention.

Locating intense sources 943 of low-energy electrons on the periphery of an electrostatic/magnetostatic cell 900 will provide greater flexibility in the design and construction of an ECD/EDD cell and, further, will allow an electron monochromator to be used as the source of electrons in order to increase the selectivity of ECD, EDD, or any other electron capture process. This capability, which is impossible to implement in RF-based and digital-based cells, will in turn make it possible to obtain much more information from studies of the energetics and kinetics of electron capture reactions as well as from tandem mass spectrometric analyses of proteins and peptides.

Figure 5:
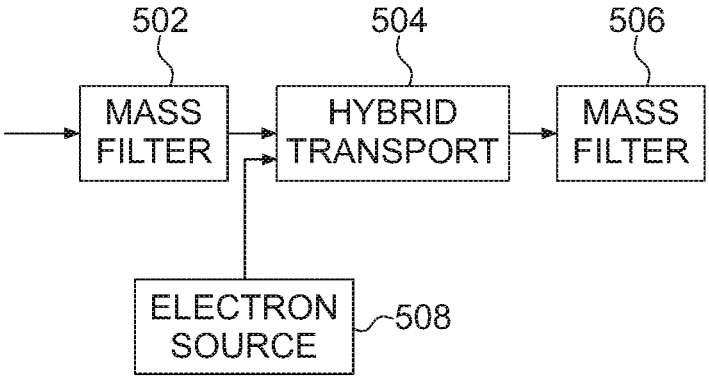
FIG. 5 schematically illustrates a representative tandem mass spectrometry method of the present invention.

Referring to FIG. 5, a representative mass spectrometer 500 includes a first quadrupole mass filter 502 situated to receive a charged particle beam to be analyzed. The first filter 502 is controlled so as to select some portion of the input charged particle beam that is then delivered to a hybrid ion guide 504 such as those illustrated in FIGS. 3A-3B and 4. In this configuration, the ion guide 504 is coupled to receive electrons from a ring filament electron source 508 as well as an ion beam after ion selection by the first filter 502. Electrons from the ring-filament electron source 508 merge with the ion beam in the ion guide 504 producing a charged particle beam that is analyzed by a second quadrupole mass filter 506 or other mass analyzer.

EXAMPLE 1

In one example in which a commercial quadrupole-mass-filter/octapole-CID-cell/quadrupole-mass-filter (QqQ) mass spectrometer (Finnigan TSQ700: Thermo Fisher Scientific, Inc., Waltham, Mass. USA) was modified by replacing the RF octapole CID cell with the ion-guide apparatus 504 configured as the ECD/CID-cell 400 in FIG. 4, ECD spectra of doubly protonated gramicidin S (Sigma Chem. Co., St. Louis, Mo. USA), doubly protonated substance P, doubly protonated neurotensin, and triply protonated neurotensin (all three from American Peptide Co, Sunnyvale, Calif. USA), were obtained without the use of either RF fields or an energy-moderating gas. Sample solutions were prepared by dissolving standards of substance P, neurotensin, and gramicidin S in $H_2O$/MeOH (50:50, v/v) to a final concentration of $10^{-5}$M.

The cell magnets 402-406 were the afore-mentioned N42SH-grade Nd—Fe—B ring-magnets (SuperMagnetMan, Birmingham, Ala. USA), the insulators 432-440 comprised 0.010" thick poly(tetrafluoroethylene), and the pole pieces 410-415 comprised soft iron. Each of the pole pieces 410-415 and the magnet's aluminum housing 420 were connected to an independently adjustable ±100-V channel of a 7-channel power supply $V_{1-6}$, $V_H$ (which could be floated up to 8 kV) so that the pole pieces 410-415 could function as electrostatic lenses as well as a pole pieces for the magnetostatic lenses 460-464. A ring-shaped, floating filament 443 of tungsten-rhenium wire of 0.07" (1.78 mm) diameter, located concentric with the cell's axis 408 at the ion-entrance, served as the source of electrons. Two titanium lenses disposed between the filament 443 and ion guide cell 400 were used to guide electrons into the cell 400.

Figure 6A:
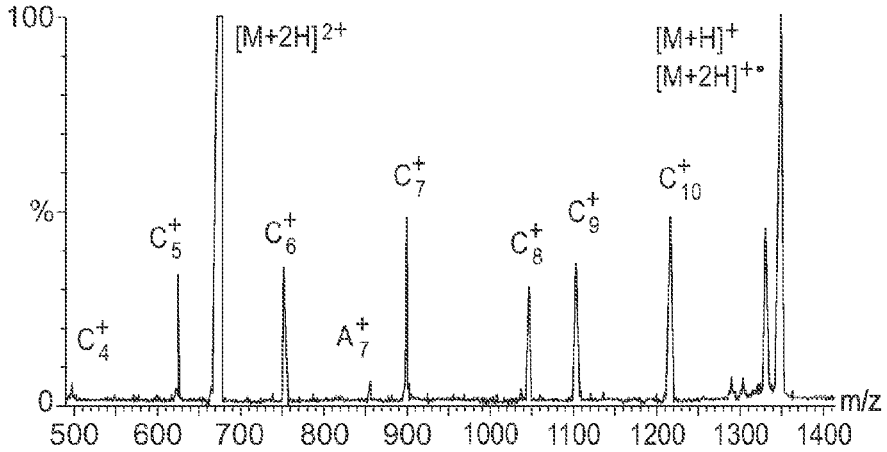
FIGS. 6A-6B illustrate ECD spectra of doubly protonated Substance P using the hybrid (radio-frequency-free) electrostatic/magnetostatic charged particle guide of FIG. 4 with a total flight time through dissociation cell ~25 μs and total flight time through dissociation cell ~12 μs, respectively.

The peptide solutions were separately electrosprayed at a flow rate of 0.2 μL/min, and doubly protonated substance P, doubly protonated gramicidin S, doubly protonated neurotensin, and triply protonated neurotensin were respectively selected as precursors. By adjusting the potentials $V_{1-6}$ on the cell's electrostatic lenses 410-415, settings were easily found that allowed the electrons emitted from the ring-filament 443 to merge in sufficient numbers with the ion beam to produce ECD spectra of doubly protonated Substance P that appear in all respects (except, obviously, in resolution) the same as those produced on FT ICR instruments, FIG. 6A. For this study, electron emission from the tungsten-rhenium filament 443 was set at 5 μA, the filament and EMS cell potentials at −120 V, the potential on the first Titanium lens Ti1 at $V_1$=−115 V, the potential on the second Titanium lens Ti2 at $V_2$=−20 V, and the potentials on all of the other lenses 410-415 at $V_{1-6}$=−80V.

Figure 6B:
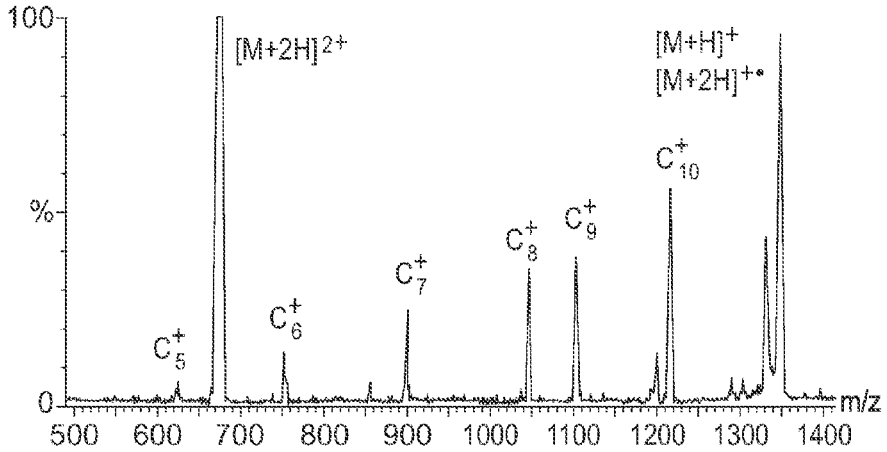

The segmented design of the ECD cell 400 provides additional opportunities for controlling electron-ion interactions and dissociation of precursor ions. For instance, by appropriately setting the potentials $V_{1-6}$ on the electrostatic lenses 410-415, the electron capture events can be forced to take place in the early entry side segments of the cell 400, and decomposition of the radical precursor ions can be observed as a function of time after electron capture. To demonstrate this possibility, the total flight time of $[M+2H]^+$. radical ions through the cell 400 was decreased (by changing the cell potential from −80 V to −300 V) from ~25 μs to ~12 μs to produce spectra within which the relative strengths of the fragment signals are markedly different (FIG. 6B). Since no changes in the relative intensities of the fragment ions were observed when the electron energy was varied, it would seem that the majority of the decrease of the intensities of the shorter c-type ions is most likely due to the decreased residence time of the radical ions, $[M+2H]^+$., inside the cell 400 before they enter the second analyzer. It is clear that the new cell 400 makes it possible to investigate the mechanisms of ECD from previously unavailable vantage points.

Figure 7A:
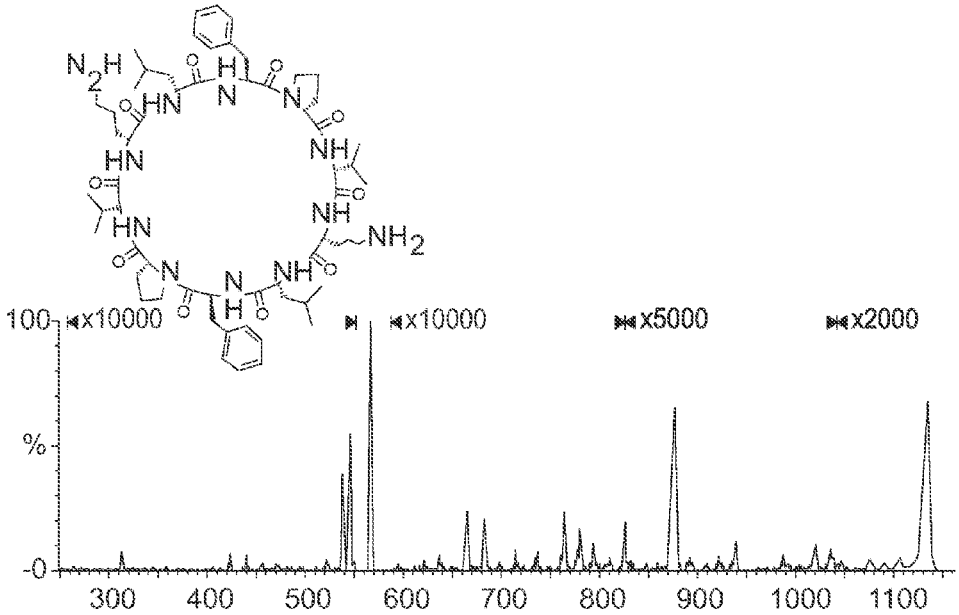
FIG. 7A illustrates a product-ion spectrum of doubly protonated gramicidin S dissociated by ECD in the flow-through five-lens electrostatic/magnetostatic cell of FIG. 4.
Figure 7B:
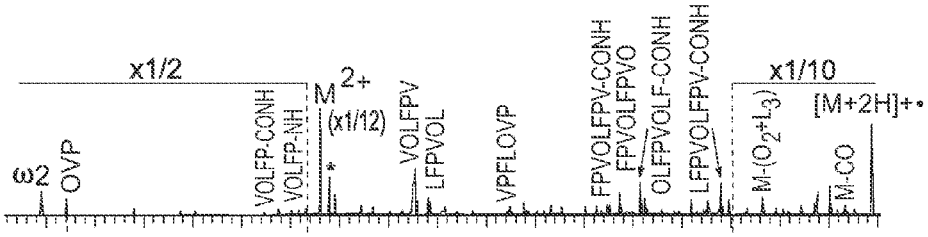
FIGS. 7B-7C illustrate product-ion spectra of doubly protonated gramicidin S dissociated by ECD and double-resonance ECD, respectively, in an FT ICR cell.
Figure 7C:
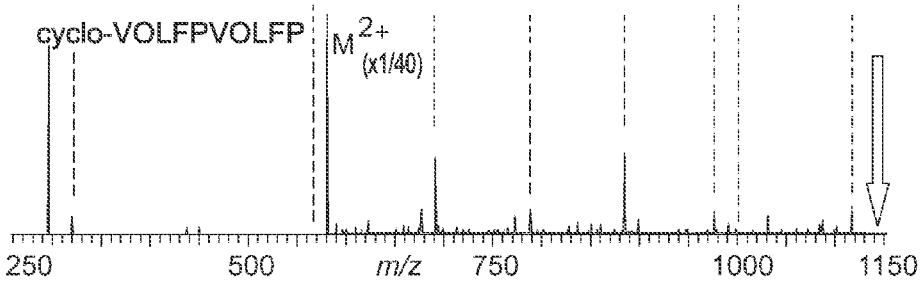
Figure 8A:
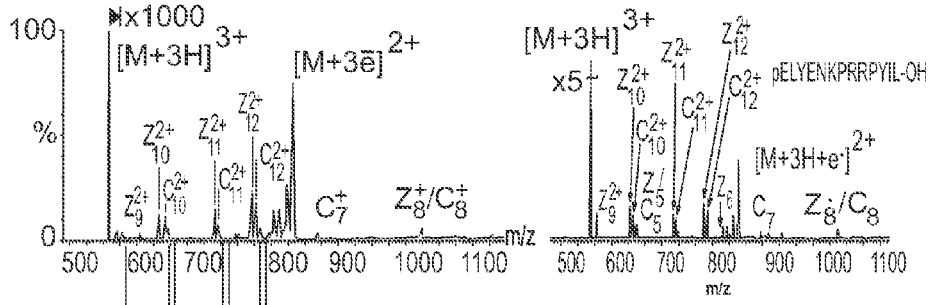
FIG. 8A illustrates electrosprayed mass spectra of neurotensin produced by selecting the triply protonated peptide ion (m/z 558) as sole precursor and performing ECD in the flow-through five-lens electrostatic/magnetostatic cell of FIG. 4 (left), and by ECD in an FT ICR cell (right).
Figure 8B:
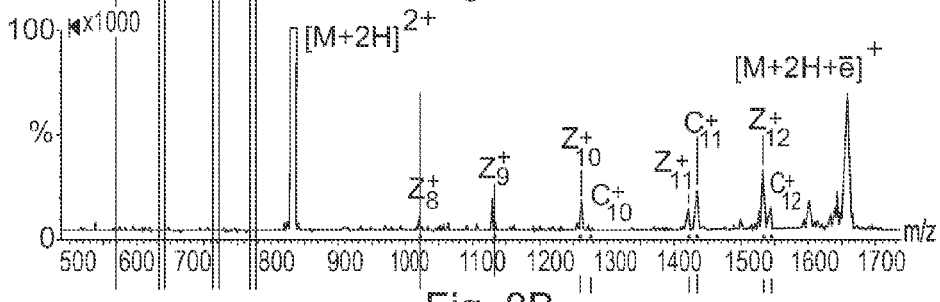
FIG. 8B illustrates an electrosprayed mass spectrum of neurotensin produced by selecting the doubly protonated peptide ion (m/z 837) as sole precursor and then performing ECD in the flow-through five-lens electrostatic/magnetostatic cell of FIG. 4.

In addition, analytical quality ECD product-ion spectra of doubly protonated gramicidin S (FIG. 7A), triply protonated neurotensin (FIG. 8A—left), and doubly protonated neurotensin (FIG. 8B) were readily produced in the RFF electrostatic/magnetostatic cell 400. These spectra were obtained without recourse to an buffering gas, as was necessary in previous efforts to perform ECD MS/MS in non-FT ICR instruments, or synchronizing electron injection with a specific phase of an RF field as was necessary in previous attempts to attain ECD in ion-traps. The cell 400 used in this study was installed in the Finnigan TSQ700 (which is a 20-year-old, low-resolution mass spectrometer that is well suited to testing prototypes but cannot produce mass spectra that yield all of the inherent information available); nevertheless, the mass spectra produced with this modified instrument incorporating the cell 400 of the present invention appear in all respects (other than the obvious exceptions of resolution and mass accuracy) to be at least as good for purposes of peptide identification as those produced by FT ICR instruments (FIGS. 7B-7C, 8A—right). (FIG. 7B-7C reproduced with permission from Elsevier from Lin et al., *J. Am. Soc. Mass Spectrom.* 2006, 17, 1605-1615, copyright 2006, and FIG. 8A—right reproduced with permission from American Chemical Society from Håkansson et al, *Anal. Chem.* 2001, 73, 3605-10, copyright 2001.) The effort and time to produce these mass spectra, however, were much less than required to produce their FT ICR counterparts.

Product-ion mass spectra of doubly protonated cyclic peptides are considerably more complex than those of linear peptides. The initial ring-opening, which statistically can occur anywhere in the backbone of the peptide, creates a mixture of linear peptides any one of which can dissociate further to produce a secondary family of fragments. The ECD product-ion spectra of cyclic peptides are no exception to this tendency. An ECD product-ion spectrum of the repetitive cyclic peptide gramicidin S recorded during this experiment (FIG. 7A) is shown for purposes of comparison with mass spectra produced on an FT ICR instrument via ECD (FIG. 7B) and double-resonance ECD (FIG. 7C). Examination of these three mass spectra and other published mass spectra of gramicidin S indicates that ECD in the RFF electrostatic/magnetostatic cell 400 produces, with comparable signal-to-background, fragment-ions corresponding to the same losses of small molecules, amino acid residues, and side chains that are generally observed in ECD product-ion spectra of gramicidin S.

ECD of triply protonated neurotensin in the RFF electrostatic/magnetostatic cell 400 produced a product-ion spectrum of both singly and doubly charged fragment ions (FIG. 8A—left) that is qualitatively identical to that produced in an FT ICR cell (FIG. 8A—right). Specifically, the RFF cell's spectrum exhibits the same six c-type and seven z.-type ions as well as the charge-reduced species $[M+3H+e^-]^{2+}$. observed in the FT ICR spectrum—only the bonds on the N-terminal side of the two prolines remained, as expected, intact.

ECD in an FT ICR cell is generally not commensurate with the time scale of liquid chromatography. By contrast, ECD in the RFF electrostatic/magnetostatic cell 400 of the present invention takes place in-flight through the device on a microsecond time scale (the time range for a singly protonated peptide of mass 1000 Da to travel through the 70-mm ECD cell 400). It should eventually be possible, therefore, to carry out ECD in the RFF cell in time with the elution of peptides off an HPLC column.

In order to perform ECD efficiently, the precursor ions must be forced to mingle with a dense population of low-energy electrons. Since the reagent electrons and the multiply protonated precursor ions have opposite polarities and masses that differ by more than six orders of magnitude, the conditions for simultaneously confining them in the same volume of space cannot be satisfied in a purely electrostatic cell, and can only be minimally satisfied in a cell in which an RF field is present. As the number of charged particles of a given polarity increases in an RF device, space-charge forces (i.e., repulsions between particles of the same polarity) result in lost particles (2D RF ion-traps) or degradation in analyzer-performance (3D ion-traps and FT ICR cells). In principle, a segmented-electrostatic-focusing/strong-periodic-magnetostatic-focusing device, e.g. cell 400, has a substantially greater charged-particle capacity than any RF-based device. Magnetic fluxes on the order of 1 T are more than strong enough to confine high volume-densities of ions and electrons with kinetic energies typically involved in electron capture reactions. This capability should make it possible to perform experiments in the RFF electrostatic/magnetostatic cell that would be at best difficult and at worst impossible in an FT ICR cell.

Figure 8C:
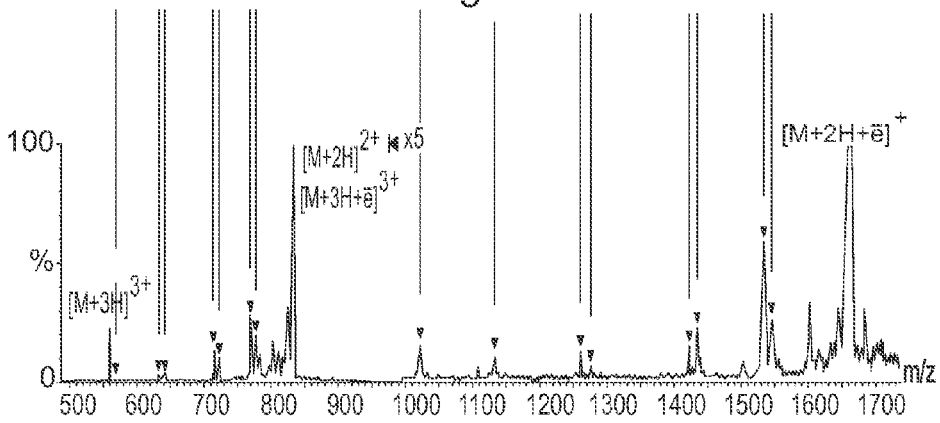
FIG. 8C illustrates an electrosprayed mass spectrum of neurotensin produced by selecting no precursor ion and performing ECD in the flow-through five-lens electrostatic/magnetostatic cell of FIG. 4.
Figure 8D:
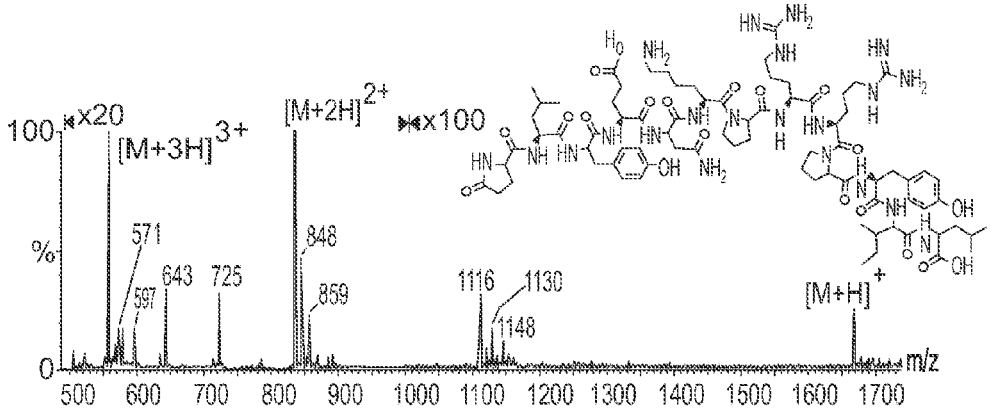
FIG. 8D illustrates an electrosprayed mass spectrum of neurotensin produced by selecting no precursor ion and performing no ECD.

An example of this was demonstrated using neurotensin as the sample. A regular mass spectrum of the electrosprayed neurotensin sample was recorded (FIG. 8D) by operating the modified Finnigan mass spectrometer strictly in the Q3-mode (i.e., setting the first analyzer Q1 in a transmission only mode and the second analyzer Q3 in a scanning mode). In addition to the peaks corresponding respectively to singly, doubly, and triply protonated neurotensin nominally at m/z 1673, 837, and 558, peaks corresponding to a number of other species appear in the spectrum. The latter are presumably due to impurities in the sample. When electrons are introduced into the dissociation cell 400, all of the impurity peaks disappear, and peaks distinctly corresponding to the ECD product ions of doubly and triply protonated neurotensin appear in their place (FIG. 8C). This becomes unequivocally evident when the composite ECD spectrum (FIG. 8C) is compared with the individually produced ECD product-ion spectra of triply (FIG. 8A) and doubly (FIG. 8B) protonated neurotensin. Clearly, recombination with electrons was sufficiently high in the RFF electrostatic/magnetostatic cell 400 to neutralize all of the impurity ions, which presumably but not necessarily were singly charged, recorded in the electrosprayed spectrum (FIG. 8D) while efficiently producing fragment ions from the doubly and triply charged neurotensin ions.

In an RFF electrostatic/magnetostatic cell, such as cell 400, the reagent electrons cannot acquire kinetic energy from the magnetic field; however, their average energy can be controlled by the potentials $V_{1-6}$ applied to the electrostatic lenses 410-415. By abandoning RF-fields altogether in favor of segmented-electrostatic focusing in conjunction with strong-magnetostatic focusing, it should be possible to conduct ECD experiments on less costly instruments in which the average kinetic energies of the ions and electrons can be controlled with minimal loss of ions or electrons in the absence of an energy-moderating bath gas. This, in turn, could make it possible to increase the product-ion yields and, thus, the information to be gained from ECD reactions to levels that are much higher than possible in any RF-based cell. The strong magnetostatic focusing provided by the cell's traveling wave tube configuration together with the capability for moving and trapping ions provided by the cell's electrostatic segments 410-415 could enable regular collision induced dissociation over a much broader range of collision energies than those typically possible in ion trap or quadrupole instruments. Moreover, the cell's design and compact construction allow it to be incorporated into virtually any type of tandem mass spectrometer, e.g., triple quadrupole, hybrid quadrupole ion trap, hybrid quadrupole time-of-flight, or even FT-ICR.

The segmentation of the RFF electrostatic/magnetostatic cell 400 makes it possible to study the energetics and kinetics of ECD reactions as well as to exploit them in MS/MS analyses. For instance, decompositions of the radical precursor ions can be observed as a function of time by limiting electron capture events to the first entry-side lens 460 of the cell 400 and adjusting the potentials on the subsequent lenses 461-464 to regulate the flight times of the product ions. This was easily demonstrated by producing an ECD product-ion spectrum of doubly protonated substance P ion at the front end of cell 400 and setting the potentials of the rest cell's electrostatic elements 410-415 for ion transport. This experimental capability could be used, for example, to investigate mechanisms like the recently proposed sequential formation of diagnostic c-type ions.

Example 2

In Example 1, it was noticed that ECD was occurring in the lens segment 460 closest to the filament 443. As a result of this observation, the size of the original cell 400 was reduced to two segments (i.e. two magnets) only, resulting in the cell 300 of FIGS. 3A-3B. The initial set of experiments with the two-segment cell 300 showed that it indeed had the same ECD efficiency as the original five-segment one. The magnets 308, 310 of the ion guide cell 300 were the afore-mentioned N42SH-grade Nd—Fe—B ring-magnets (SuperMagnetMan, Birmingham, Ala. USA), the insulators 318-321 comprised 0.010" thick poly(tetrafluoroethylene), and the pole pieces 312, 314, 316 comprised soft iron. The working embodiment included a gas line (pipe) 352 providing collision gas (e.g., Argon) for CID into the cell 300 through the iron pole piece 314 separating magnets 308, 310. For ECD, electron emission from the tungsten-rhenium filament was set at 10 μA, the filament and EMS cell potentials at −120 V, the potential on the first Titanium lens Ti1 at $V_1$=−115 V, the potential on the second Titanium lens Ti2 at $V_2$=−20 V, and the potentials on all of the other lenses 410-415 at $V_{1-6}$=−80 V.

Figure 12A:
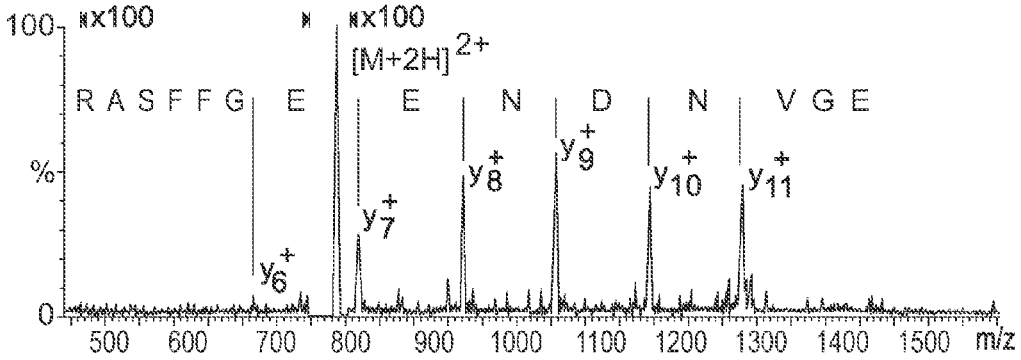
FIG. 12A illustrates a spectrum of doubly protonated Glu-fibrinopeptide produced by CID in the two-lens hybrid electrostatic/magnetostatic cell of FIG. 3.
Figure 12B:
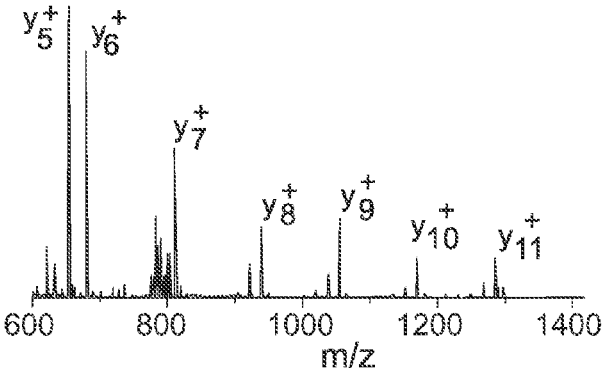
FIG. 12B illustrates a spectrum of doubly protonated Glu-fibrinopeptide produced by CID using an Applied Biosystems Q-STAR XL hybrid quadrupole-TOF mass spectrometer.

The two-segment cell 300 was tested in the CID mode by using Ar as the collision gas, setting the cell's potential so that the ion energy (laboratory frame of reference) was 200 eV, and recording a CID product-ion spectrum of doubly protonated Glu-fibrinopeptide, FIG. 12A. Prior to introduction of the gas, the vacuum inside the instrument analyzer manifold was 1.8 mTorr ($1.8\times10^{-5}$ mmHg). When collisonal gas was added, it became 2.1 mTorr ($2.1\times10^{-5}$ mmHg). Comparison of this spectrum with a published spectrum, FIG. 12B (Wang B. et al., "Isotopologue Distributions of Peptide Product Ions by Tandem Mass Spectrometry: Quantitation of Low Levels of Deuterium Incorporation", Anal Biochem. 2007, 367(1), 40-48. Reprinted with permission from Elsevier.) shows that both spectra exhibit the same series of y-type ions, but that the distributions of their respective peak intensities have distinctly different envelopes.

Figure 13A:
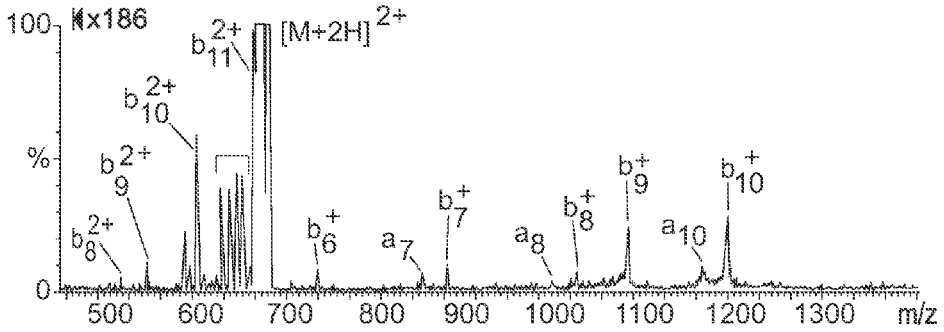
FIG. 13A illustrates a spectrum of doubly protonated substance P produced by CID in the two-lens hybrid electrostatic/magnetostatic cell of FIG. 3.

After having demonstrated that the two-segment cell 300 could be operated in both ECD and CID modes independently, simultaneous ECD and CID was attempted in the cell 300 on doubly protonated substance P. This was done by first recording a CID product-ion spectrum of the peptide, FIG. 13A, and subsequently turning on the electron filament to record its combined ECD/CID spectrum, FIG. 13B.

Figure 13B:
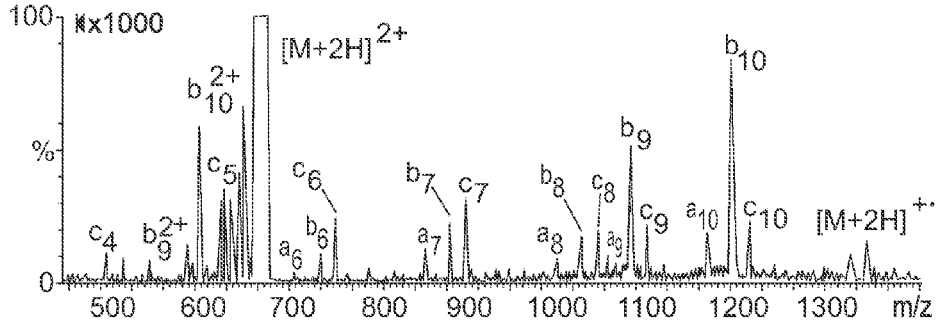
FIG. 13B illustrates a spectrum of doubly protonated substance P produced by simultaneous ECD and CID in the two-lens electrostatic/magnetostatic cell of FIG. 3, with the ion signals labeled with b's and a's correspond to fragments produced by CID, and the ion signals labeled with c's correspond to fragments produced by ECD.

In the CID product-ion spectrum of substance P, FIG. 13B, a relatively complete series of b-type fragment ions accompanied by a less intense series of a-type fragment ions is observed, as is generally the case for a peptide that has an arginine on its N-terminus. In the combined CID/ECD production ion spectrum, the CID series of b-type and a-type ions is virtually unchanged; however, superimposed on this CID series of fragment-ion peaks is a series of the same six c-type ions (i.e., $c_4$-$c_{10}$) typically observed in an ECD product-ion spectrum of substance P. This result demonstrates the "golden complementary pairs" (actually, the presence of a-, b-, and c-type ion signals in a single product-ion mass spectrum constitutes triplets in this particular example) being recorded in a single, simultaneous (i.e., non-tandem), in-flight, ECD/CID experiment.

If the filament were left on to produce electrons for ECD and the gas valve left open to provide collision gas for CID, any combination of ECD, CID, or ECD/CID experiments could be interchangeably carried out in the cell hybrid electrostatic/magnetostatic cell 300. Reducing the filament's potential would stop the ECD process and, increasing the cell's potential (i.e., making it less negative) would stop the CID process. Since voltages can easily be switched in nanoseconds, changing from one dissociation mode to another can easily be done on a time-scale commensurate with the ions' flight times through the mass spectrometer (i.e. microseconds). Rapidly switching the ECD mode off and on while recording a product ion spectrum could, for example, be used to confirm the presence of golden complementary pair or triplets. Use of a fast, automated, alternating dissociation mode with the hybrid electrostatic/magnetostatic cell of the present invention also might, when used in conjunction with Walsh-Hadamard transforms, be a means for increasing signal-to-noise ratio or for decreasing the duty cycle in time-of-flight measurements of product ions.

By this experiment, a-, b-, and c-type ion signals have been recorded in a single product-ion mass spectrum by simultaneously performing ECD and CID in a hybrid electrostatic/magnetostatic cell 300 of the present invention. Use of this technique in MS/MS analyses of peptides could significantly increase the number of peptides (and ergo proteins) that can be accurately matched to sequence entries in genomic and proteomic data-bases and even sequenced de novo.

The ion guides disclosed herein can be adapted to accommodate one or many dissociation processes. The interleaved, periodic focusing of a hybrid electrostatic/magnetostatic structure permits PID, low- and high-energy CID, ETD, ECD, EDD, and EIEIO either individually or in sequential combinations. Any one of several possible embodiments of the disclosed dissociation cells can be inserted between two analyzers of any transmission/transmission or transmission/trapping tandem mass spectrometer. Furthermore, if a mass spectrometer comprises two or more tandem units, any one of several possible embodiments of the disclosed device can be incorporated in each unit.

As shown above, the disclosed hybrid electrostatic/magnetostatic ion guides 300, 400 are segmented so that precursors, reagent ions, and electrons can be segregated, trapped, and combined. For example, in an ECD or EDD experiment, limiting electron capture events to the first one or two entry-side segments of the cell, e.g. at electrostatic lenses 414, 410, and appropriately adjusting the potentials on the subsequent lenses, e.g., lenses 412-415, would make it possible to observe decompositions of the radical precursor ions as a function of time. If the magnets in an electrostatic/magnetostatic hybrid cell's magnetic lens-elements were situated to provide radial focusing, ions would propagate through the cell along sinusoidal paths and the added path length created by this extra motion might be used to engineer more compact spectrometers, more selective spectrometers, or both. Ion-mobility spectrometers incorporate funnel and hourglass ion-guides to collect and concentrate ions both before entering and after exiting the ion-mobility tube; engineering these auxiliary components as electrostatic/magnetostatic structures could result in higher transmission efficiencies and, thereby, lower detection limits.

In some configurations, hybrid cells 300, 400 as disclosed herein are configured to perform high energy CID. In such procedures, electrical potentials applied to pole pieces 312-316, 410-415 or to conductive aperture plates are selected to accelerate precursors to kinetic energies greater than, for example, about 1 keV. In other configurations, charged particles associated with different arrival times can be trapped in respective sections of a hybrid cell 300, 400, and released for subsequent analysis based on time varying potentials applied to the pole pieces 312-316, 410-415.

In typical configurations, ion guides comprise at least one magnetic lens that includes a magnet and a pair of ferromagnetic pole pieces. In configurations that include two or more such magnetic lenses, each magnetic lens can include two pole pieces, but in some configurations, magnetic lenses share a pole piece that is situated between magnets of adjacent lenses. In other configurations, separate pole pieces can be provided.

Figure 2C:
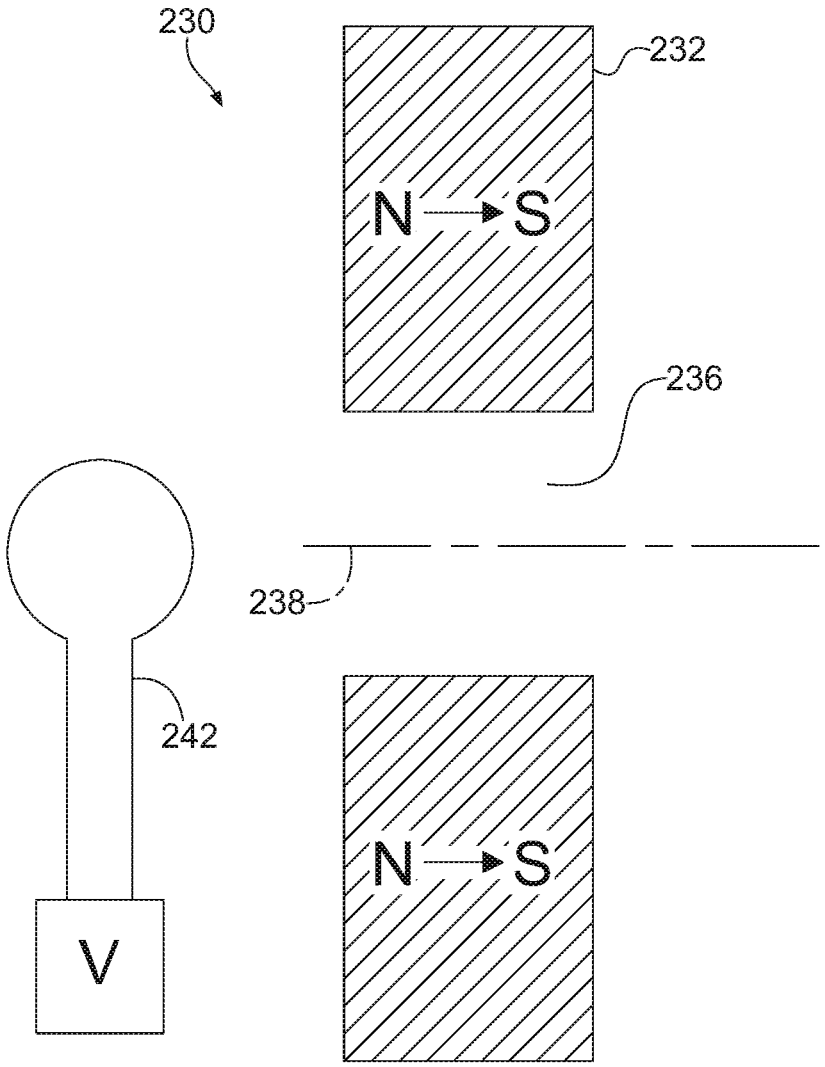
FIG. 2C schematically illustrates, in partial cross-section, an exemplary dissociation cell of the present invention based on a single magnet and a single applied potential.
Figure 2D:
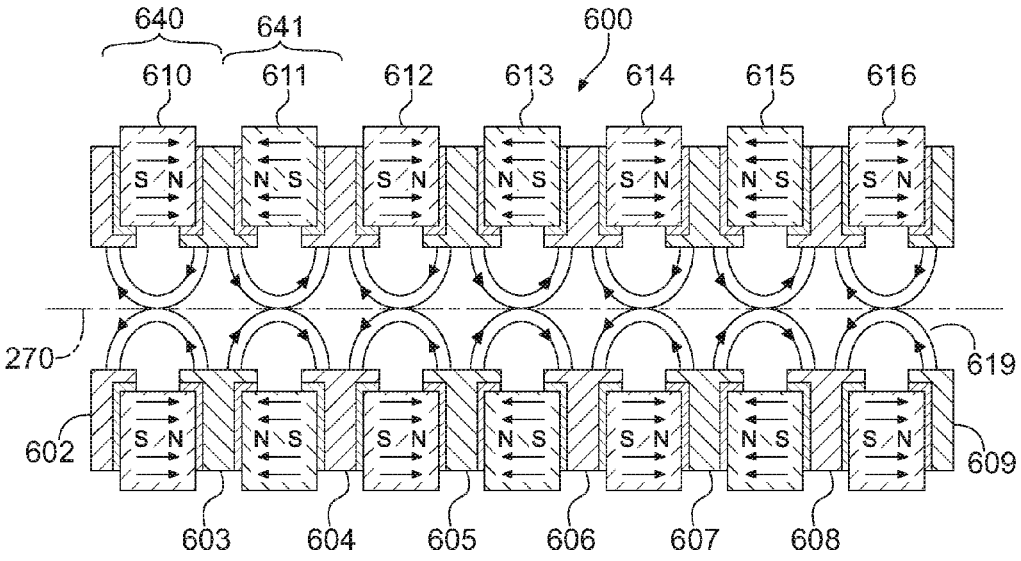
FIGS. 2D-2E schematically illustrate cross-sectional side-views of exemplary magnetic lens arrays configured to provide axial and radial focusing, respectively, that are based on the single magnetic lens configurations of FIGS. 2A-2B.
Figure 2E:
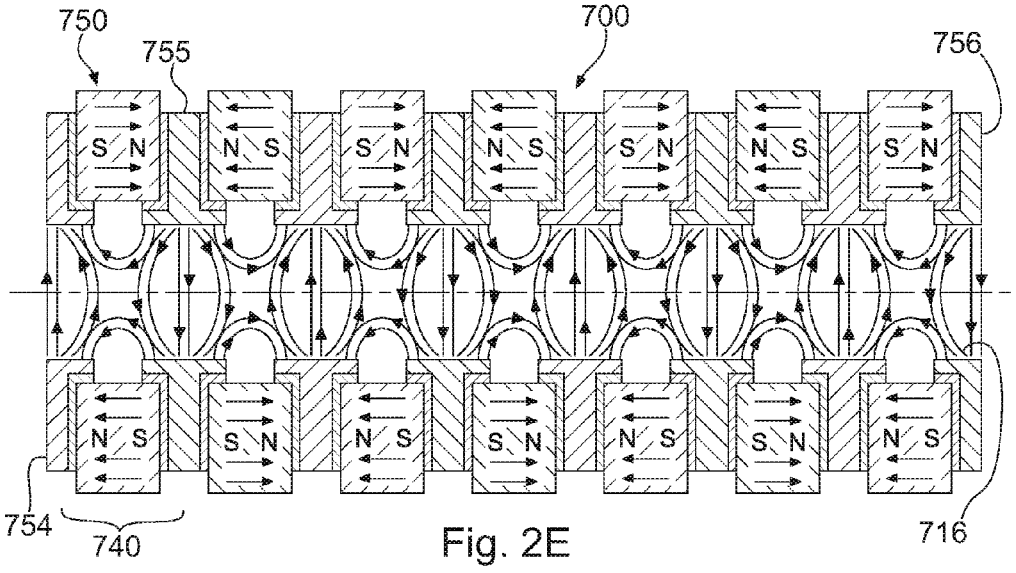

With reference to FIG. 2C, a representative fragmentation cell 230 comprises a ring magnet 232. The cell is situated on an axis 238 and defines a fragmentation volume 236 that extends along the axis 238. In other configurations, a non-conductive magnet provided with a conductive layer is used, and an electrical connector is provided to apply a voltage to the magnet that is different than an instrument ground or other instrument voltage. In other configurations, the magnet 232 is an electromagnet or a combination of an electromagnet and a permanent magnet. Insulator layers or insulating coatings can be provided if desired for a particular application. As shown in FIG. 2C, a filament 242 is situated to produce electrons for coupling into the fragmentation volume 236.

It will be apparent that the disclosed exemplary configurations are representative only, and the disclosure is not to be limited to the particular exemplary configurations used for illustration. For example, magnets can be segmented into one or more pieces and/or can be polarized in any technically possible manner to conveniently provide suitable magnetic field polarities, and electromagnets can be used instead of permanent magnets, or combinations of electromagnets and permanent magnets can be used. Magnets can be made from electrically non-conductive materials such as ceramics. Using such magnets, insulators configured to electrically isolate magnets from pole pieces or conductive aperture plates are unnecessary. In other examples, magnets can be covered or partially covered by one or more electrically insulating layers such as an epoxy layer. In some embodiments, a separate housing is provided to secure the magnets and pole pieces, but in other examples, some or all magnets and/or pole pieces can be secured with an adhesive, and a housing can be omitted. In the examples described above, two or more magnets and associated pole pieces are provided. In other examples, a single magnet and two associated pole pieces configured to be maintained at different electrical potentials can be provided. In view of these and other variations, we claim all that is encompassed by the appended claims.

We claim:

1. A mass spectrometry apparatus, comprising:

a) from a first end to a second end along an axis:

a first conductive aperture electrically connected to a first electrical potential;

a first magnetostatic lens;

a second conductive aperture electrically connected to a second electrical potential, wherein the first and second conductive apertures and the magnetostatic lens define a radio-frequency-free charged particle interaction cavity that extends along the axis; and b) a source of electrons disposed between the first and second conductive apertures, wherein the magnetostatic lens comprises a Halbach array.

2. The mass spectrometry apparatus of claim 1, comprising a second magnetostatic lens disposed along the axis adjacent the second conductive aperture.

3. The mass spectrometry apparatus of claim 2, wherein the source of electrons is disposed between the first and second magnetostatic lenses.

4. The mass spectrometry apparatus of claim 3, wherein the source of electrons is disposed along a radius perpendicular to the axis.

5. The mass spectrometry apparatus of claim 1, wherein the first and second conductive apertures each comprise an electrostatic lens.

6. The mass spectrometry apparatus of claim 4, wherein the source of electrons is disposed external to the cavity and the first and second magnetostatic lenses.

7. The mass spectrometry apparatus of claim 1, wherein the source of electrons is disposed external to the cavity and the magnetostatic lens.

8. The mass spectrometry apparatus of claim 7, wherein the source of electrons is disposed along a radius perpendicular to the axis.

9. The mass spectrometry apparatus of claim 1, wherein the first and second conductive apertures each comprise an electrostatic lens.

* * * * *